US006371863B1

(12) United States Patent
Moran

(10) Patent No.: US 6,371,863 B1
(45) Date of Patent: Apr. 16, 2002

(54) GOLF SWING TRAINING DEVICE

(76) Inventor: Thomas F. Moran, 19601 Van Aken Blvd., Apt. 56, Shaker Heights, OH (US) 44122

( * ) Notice: Subject to any disclaimer, the term of this patent is extended or adjusted under 35 U.S.C. 154(b) by 0 days.

(21) Appl. No.: 09/439,577

(22) Filed: Nov. 12, 1999

(51) Int. Cl.[7] ..... A63B 69/36
(52) U.S. Cl. ..... 473/207; 473/276
(58) Field of Search ..... 473/207, 266, 473/276; 273/188 R; 482/148

(56) References Cited

U.S. PATENT DOCUMENTS

| | | | | | |
|---|---|---|---|---|---|
| 2,611,610 | A | * | 9/1952 | Hara | 473/207 |
| 3,397,892 | A | * | 8/1968 | Stahl | 473/207 |
| 3,595,583 | A | | 7/1971 | Oppenheimer | |
| 4,326,718 | A | | 4/1982 | Kiehl | |
| 4,758,000 | A | | 7/1988 | Cox | |
| 5,039,105 | A | | 8/1991 | Ro | |
| 5,050,885 | A | | 9/1991 | Ballard et al. | |
| 5,441,271 | A | | 8/1995 | Briggs | |
| 5,586,761 | A | | 12/1996 | Brock et al. | |
| 5,688,212 | A | | 11/1997 | Walker | |
| 5,792,031 | A | | 8/1998 | Alton | |
| 6,174,270 | B1 | * | 1/2001 | Dagenais | 473/276 |

FOREIGN PATENT DOCUMENTS

| | | |
|---|---|---|
| WO | WO 98/31437 A | 7/1998 |
| WO | WO 99/32199 A | 7/1999 |

* cited by examiner

*Primary Examiner*—Mark S. Graham
*Assistant Examiner*—Raeann Gorden
(74) *Attorney, Agent, or Firm*—Rankin, Hill, Porter & Clark LLP

(57) ABSTRACT

The present invention relates to a golf swing training device that guides and coordinates a user's body position and lateral, vertical, and rotational movement when executing a golf swing relative to a target line extending horizontally in the direction of an intended target from a predetermined point at which the user would strike a golf ball with a golf club. The golf swing training device according to the present invention includes a yoke, a rotatable member, and a guide assembly. The yoke engages the upper torso of the user. The rotatable member is connected to the yoke. The guide assembly maintains the orientation of the rotatable member while it simultaneously rotates and moves laterally and vertically as the user executes a golf swing. In a preferred embodiment, the golf swing training device further includes an extensible rod that is pivotally connected on one end to the yoke proximal to the position of the user's sternum and is connected on the other end by a hinge to a coupler which preferably clamps onto the grip end of a golf club.

21 Claims, 16 Drawing Sheets

GOLF SWING TRAINING DEVICE

BACKGROUND OF THE INVENTION

1. Field of Invention

The present invention relates to a golf swing training device. More particularly, the present invention relates to a golf swing training device that guides and coordinates a user's body position and lateral, vertical, and rotational movement when executing a golf swing.

2. Background of the Invention

When a golfer properly executes a golf swing, the relatively planar face of a golf club head moving at a relatively high velocity collides with a golf ball which is at rest on or near the ground. The force of the collision causes the golf ball to compress slightly against the face of the club head, which may also undergo some temporary deformation. Because the mass of the golf ball is significantly less than that of the moving club head, the collision also causes the golf ball to become accelerated in the direction of the force being applied to it by the club head. The face of the club head is usually lofted a predetermined number of degrees from vertical and scored with horizontal grooves. The horizontal grooves in the face of the club head engage the relatively soft cover of the golf ball during compression and prevent the ball from sliding up the face. As the golf ball decompresses and begins to spring off of the face of the club head, the horizontal grooves coupled with the loft angle of the club frictionally impart a backward spin and a rising trajectory to the golf ball. The spin axis of a properly struck golf ball is substantially horizontal and perpendicular to a target line, which is an imaginary line extending horizontally in the direction of an intended target from the point at which the golfer struck the golf ball with the golf club. After springing off of the face of the club head, a properly struck golf ball, which is usually dimpled to reduce drag and increase lift, travels in a desired direction for a desired distance and comes to rest again on the ground at the intended target, assuming of course that the flight of the ball is not affected by other forces, such as wind.

It will be appreciated that the golf ball is in contact with the face of the club head for only a brief period of time during the golf swing. However, if the golf ball is to travel on a straight path to the intended target, meaning that the golf ball generally travels in a vertical plane that contains the target line, it is imperative that throughout the brief period of time the golf ball is in contact with the golf club the golfer maintains the club head such that the horizontal grooves in the club face are substantially perpendicular (i.e., square) to the target line. To hit a straight shot, it is also imperative that the golfer maintain the movement of the golf club such that the club face moves substantially along the target line while it is in contact with the ball. And, for most golf shots, it is also imperative that the golfer cause the club head to be moving at a relatively high rate of speed at the time of the collision with the ball in order to impart a sufficient force to the golf ball to cause it to travel to the intended target.

If the golf swing is not executed as described, the golf ball will not travel on a generally straight path to the intended target. For example, if the horizontal grooves in the club face are not substantially perpendicular to the target line when the head of the golf club strikes the golf ball, the spin axis of the golf ball will not be substantially horizontal and perpendicular to the target line and the golf ball will tend to curve in flight to the right or to the left of the direction of the force applied by the club. For a right-handed golfer, a trajectory deviation to the right of the target line caused by an improper spin imparted to the golf ball is referred to as a slice, and a trajectory deviation to the left caused by an improper spin imparted to the golf ball is referred to as a hook. In addition, if the movement of the club head while it is in contact with the golf ball is in a direction other than substantially along the target line, the force transferred to the golf ball will cause it to become accelerated to the right or left of the target line, which for a right-handed golfer is called a push or pull, respectively. These terms are reversed for a left-handed golfer. Other factors, such as the steepness or shallowness of the swing arc of the golf club, the velocity and acceleration of the golf club head at the moment of impact, the point on the face of the golf club which makes contact with the golf ball, and other factors can also have a significant affect on whether the golf ball comes to rest near its intended target.

Significant practice is required in order for a golfer to learn how to execute a golf swing that will result in a golf ball consistently traveling to an intended target. Unfortunately, if during such practice the golfer learns poor swing mechanics or other bad habits resulting in swing flaws, such flaws can become grooved in the golfer's swing. In other words, the golfer's muscles become accustomed to executing a golf swing having one or more flaws or faults. A golfer who has grooved a swing with a flaw or fault has a very difficult time correcting the golf swing, primarily because the golfer does not know what a proper swing is supposed to feel like or look like. Accordingly, rather than correcting the swing flaw, the golfer will more likely make a compensation in some other portion of the swing to adjust for the improper flight characteristics of the golf ball caused by the swing flaw. A classic example of this situation is a right-handed golfer with a swing flaw which produces a pronounced slice compensating for the slice by aiming far to the left of the intended target. Making compensations such as this may allow the golfer to hit the golf ball in the general direction of the intended target, but such compensations result in a loss of distance, decreased accuracy, and inconsistency. Furthermore, making such compensations tends to compound the number of swing flaws in the golfer's swing, making it even worse and more difficult to correct. Accordingly, it is better to learn and groove proper golf swing having no flaws or faults.

A proper golf swing begins from an address position and includes a back swing, a down swing, and a follow through. In the address position, the golfer stands a distance away from and facing the golf ball. The golfer's feet are placed generally astride an imaginary horizontal line that passes through the golf ball perpendicular to the target line. The golfer takes a comfortable grip on the grip end of the golf club and places the club head to the side of the golf ball opposite the target.

The first part of the golf swing is called the back swing. During the back swing, the golfer takes the club head away from the golf ball while rotating (i.e. turning) his or her hips and upper torso away from the intended target. Ideally, the golfer's shoulders should rotate up to about 90°, and the golfer's hips should rotate up to about 45° from the address position during the back swing. Once the golfer has completed the back swing, the golfer then executes the second part of the golf swing called the down swing. The point at which the golfer transitions from the back swing to the down swing is called the top of the back swing. During the down swing, the golfer turns back toward the golf ball. The golfer strikes the golf ball with the face of the club head at the bottom of the down swing. In the brief period of time that the golf ball is on the club face, the down swing transitions into the third part of the golf swing called the follow through. During the follow through, the golfer completes a turn in the direction of the intended target. Ideally, the golfer's shoulders should rotate up to about 180° and the golfer's hips should rotate up to about 90° from the position they were in at the top of the back swing.

Videotape recordings and stop-action photographs taken of professional golfers show that in addition to the rotational body movement previously described, a proper golf swing also involves lateral and vertical movement. From the address position, the upper torso of most professional golfers moves laterally away from the intended target a distance in a direction generally parallel to the target line as the golfer turns or rotates his or her hips and shoulders away from the target during the back swing. This lateral movement coupled with the simultaneous rotation of the golfer's hips and shoulders causes the golfer to also simultaneously move a distance in a generally downward direction (i.e., toward the horizontal plane that includes the target line) during the back swing. During the down swing, the golfer simultaneously counter-rotates by turning his or her hips and shoulders back toward the golf ball while his or her upper torso moves laterally in the direction of the intended target. The uncoiling of the golfer's body during the down swing results in a simultaneous upward or vertical movement relative to the horizontal plane containing the target line. During the follow through portion of the golf swing, the golfer's hips and shoulders complete a body turn toward the target and the golfer continues to move laterally toward the target. As the golfer completes the follow through the golfer simultaneously continues to rise or move in a generally vertical direction relative to the horizontal plane.

The prior art is replete with golf swing training devices that are intended to guide a user through the proper mechanics of a golf swing. Unfortunately, these prior art devices universally fail to account for the lateral and vertical movements of the user's body during a properly executed golf swing. In fact, most prior art mechanical golf swing training devices force the user to execute a golf swing by rotating about a single fixed axis thereby training the user to attempt to execute the golf swing without making any lateral and/or vertical movements. Clearly, such prior art mechanical golf swing training devices do not take into account the dynamic movement of the human body during a properly executed golf swing. A mechanical device is needed that can guide and coordinate a user's body position and lateral, vertical, and rotational movement when executing a golf swing so that golfers can learn and practice how to execute a proper golf swing.

SUMMARY OF THE INVENTION

The present invention provides a new golf swing training device for use in training a user how to execute a proper golf swing. The golf swing training device according to the present invention guides and coordinates the user's body position and lateral, vertical, and rotational movement when executing a golf swing relative to a target line extending horizontally in the direction of an intended target from a predetermined point at which the user would strike a golf ball with a golf club. The golf swing training device according to the present invention includes a yoke, a rotatable member, and a guide assembly. The yoke engages the upper torso of the user and includes an attachment point that is preferably positioned above and intermediate the user's shoulders. The rotatable member is connected to the yoke at the attachment point. The rotatable member has an axis of rotation that lies within a first plane that is. The guide assembly maintains the orientation of the rotatable member as it simultaneously rotates and moves laterally and vertically while the user executes a golf swing. Preferably, the guide assembly maintains the orientation of the rotatable member such that a first angle between the first plane and a horizontal plane that contains the target line, and a second angle between the axis of rotation of the rotatable member and a line of intersection between the first plane and the horizontal plane, both remain constant while the rotatable member simultaneously rotates and moves laterally away from the target and toward the horizontal plane as the user executes a back swing and counter-rotates and moves laterally toward the target and away from the horizontal plane as the user executes a down swing and follow through. In a preferred embodiment, the golf swing training device further includes an extensible rod that is pivotally connected on one end to the yoke proximal to the user's sternum and is connected on the other end by a hinge to a coupler which preferably clamps onto the grip end of a golf club.

To use the golf swing training device according to the present invention to learn and/or practice the rotational, lateral, and vertical movements involved in executing a proper golf swing, a user first positions his or her upper torso in the yoke. In a preferred embodiment, the yoke includes a front portion disposed generally adjacent to the user's chest, a back portion disposed generally adjacent the user's back, and a connecting portion connecting the front portion and the back portion and extending to an attachment point located above and intermediate the user's shoulders. With his or her upper torso positioned in the yoke, the user takes a comfortable stance a distance away from and facing a golf ball that has been placed on a predetermined point on a target line. The user's feet should preferably be placed generally astride an imaginary horizontal line perpendicular to the target line that passes through the predetermined point on which the golf ball has or would be placed. The user then preferably takes a comfortable grip on the grip end of a golf club that has been attached to the coupler pivotally connected to the end of the extensible rod. The user then assumes an address position with the head of the golf club placed on the side of the predetermined pont opposite the target and subsequently executes a golf swing that includes a back swing, a down swing, and a follow through. The golf swing training device according to the present invention guides and coordinates the user's body position and lateral, vertical, and rotational movement during the golf swing by limiting and controlling the position and movement of the user's upper torso which is engaged in and restrained by the yoke.

The optional extensible rod and coupler assembly forces the user's hands and arms to be in the proper position relative to the user's body throughout the golf swing, which results in the golf club being maintained in the proper position (i.e., generally perpendicular) relative to the user's spine and in the proper swing plane during the back swing. At the top of the back swing, the hinge connecting the lower portion of the extensible rod to the coupler allows the user to properly cock his or her wrists in the appropriate plane. As the user begins the down swing, the extensible rod and coupler assembly forces the user to keep the golf club in the proper swing plane at all times. At the point in the swing at which the user would impact the golf ball with the head of the golf club, the extensible rod and coupler assembly keeps the user's arms and the golf club in the proper relationship with the horizontal grooves in the face of the club being maintained substantially perpendicular or square to the target line.

It will be appreciated that a user can use the golf swing training device according to the present invention without using the optional extensible rod and coupler assembly. Furthermore, it will be appreciated that the user can use the device without gripping a golf club. The user can obtain substantial benefits simply by repeatedly executing the body movements of a proper golf swing relative to a target line with or without gripping a golf club or hitting a golf ball. Whether using a golf club or not, the golf swing training device according to the present invention permits a user to exercise the muscles involved in executing a proper golf swing, which helps the user learn and groove the body positions and rotational, lateral and vertical movements of a proper golf swing.

The golf swing training device according to the present invention is particularly useful for providing the user with the look, sound, and feel (i.e., kinesthesia) of a properly executed golf swing. As the user executes a golf swing, the yoke guides and coordinates the user's body position and rotational, lateral, and vertical movement. The yoke provides resistance to the user's upper torso if the user attempts to move or rotate in an improper manner while executing the golf swing.

Preferably, a user uses the golf swing training device according to the present invention while receiving golf instruction from a trained golf teaching professional who can help the user identify and correct swing flaws. After executing repeated golf swings with the golf swing training device attached to his or her own playing clubs, the user's muscles will become accustomed to the feel of a properly executed golf swing, and the user will also know what a properly executed golf swing should look and sound like. Through repeated use of the golf swing training device according to the present invention, the user will groove a golf swing which has no flaws or faults. Unlike many of the prior art golf training devices, the golf swing training device according to the present invention allows the user to strike golf balls using the user's actual playing clubs during practice which gives the user the ability to feel, see, and hear how a properly struck golf ball reacts.

These and other advantages are provided by the present invention of a golf swing training device for use in guiding and coordinating a user's body position and lateral, vertical, and rotational movement when executing a golf swing relative to a target line extending horizontally in the direction of an intended target from a predetermined point at which the user would strike a golf ball with a golf club, the golf swing training device comprising: a yoke for engaging the upper torso of the user; a rotatable member that is connected to the yoke; and a guide assembly that maintains the orientation of the rotatable member while it simultaneously rotates and moves laterally and vertically as the user executes a golf swing.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE PREFERRED EMBODIMENTS

Preferred Configuration of the Device

Figure 1:
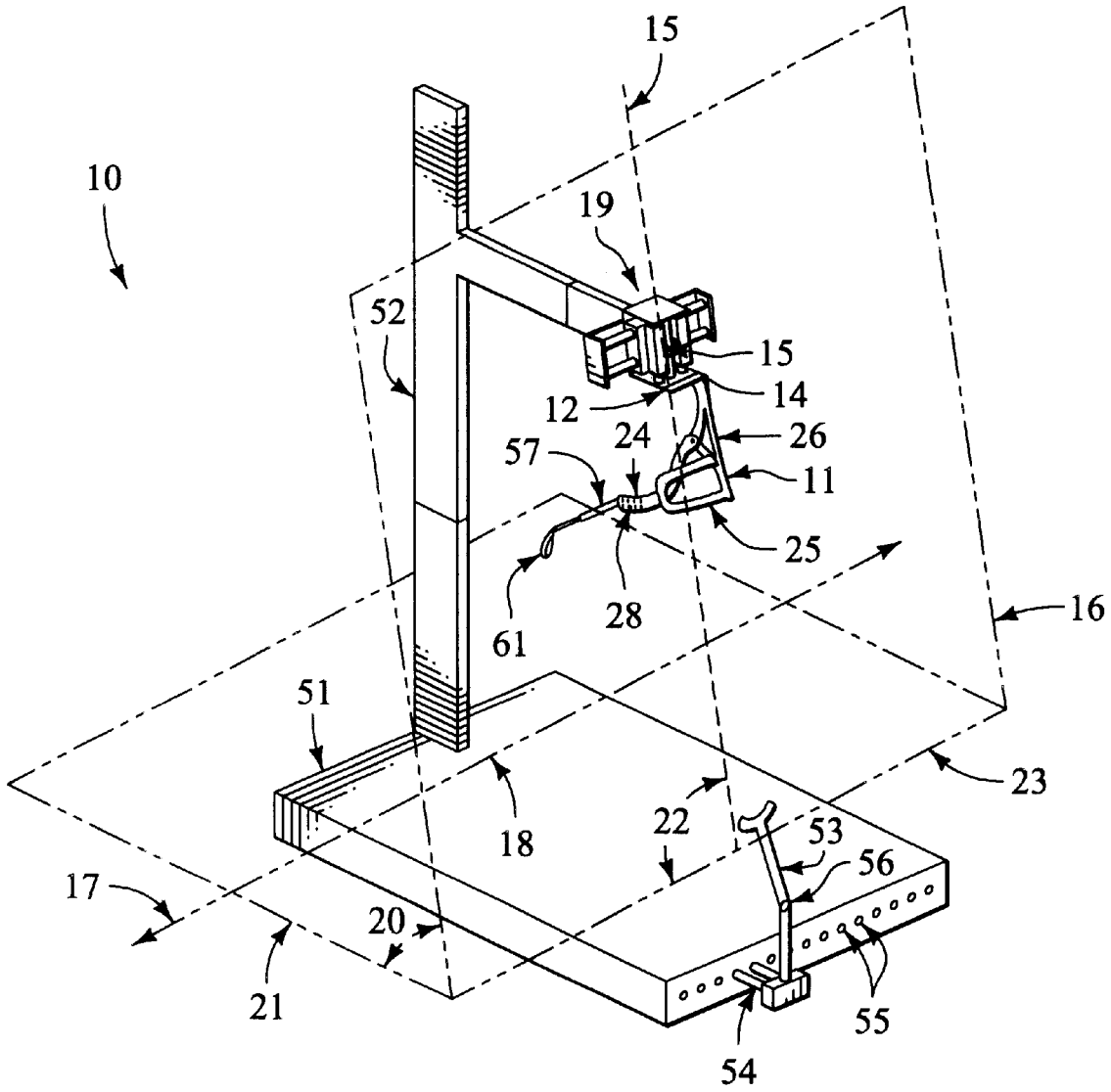
FIG. 1 is a perspective view of one preferred embodiment of the golf swing training device of the present invention.

With reference to FIG. 1, a golf swing training device 10 according to the present invention comprises a yoke 11, a rotatable member 13, and a guide assembly 19. A user positions his or her upper torso in the yoke 11, which includes an attachment point 12 for being positioned above and intermediate the user's shoulders. An end 14 of the rotatable member 13 is connected to the attachment point 12 of the yoke 11. The rotatable member 13 has an axis of rotation 15 lying within a first plane 16 that is generally parallel to a target line 17. The target line 17 is an imaginary line extending generally horizontally in the direction of an intended target from a predetermined point 18 at which the user would strike a golf ball with a golf club. The guide assembly 19 maintains the orientation of the rotatable member 13 as the user executes a golf swing relative to the target line 17. The orientation of the rotatable member 13 is maintained by the guide assembly 19 as it simultaneously rotates and moves laterally vertically. Preferably, the guide assembly 19 maintains the orientation of the rotatable member 13 such that a first angle 20 between the first plane 16 and a horizontal plane 21 that contains the target line 17, and a second angle 22 between the axis of rotation 15 of the rotatable member 13 and a line of intersection 23 between the first plane 16 and the horizontal plane 21, both remain constant while the rotatable member 13 simultaneously rotates and moves laterally away from the target and toward the horizontal plane 21 as the user executes a back swing and counter-rotates and moves laterally toward the target and away from the horizontal plane 21 as the user executes a down swing and follow through. The various elements comprising the invention are discussed in greater detail below.

Figure 2:
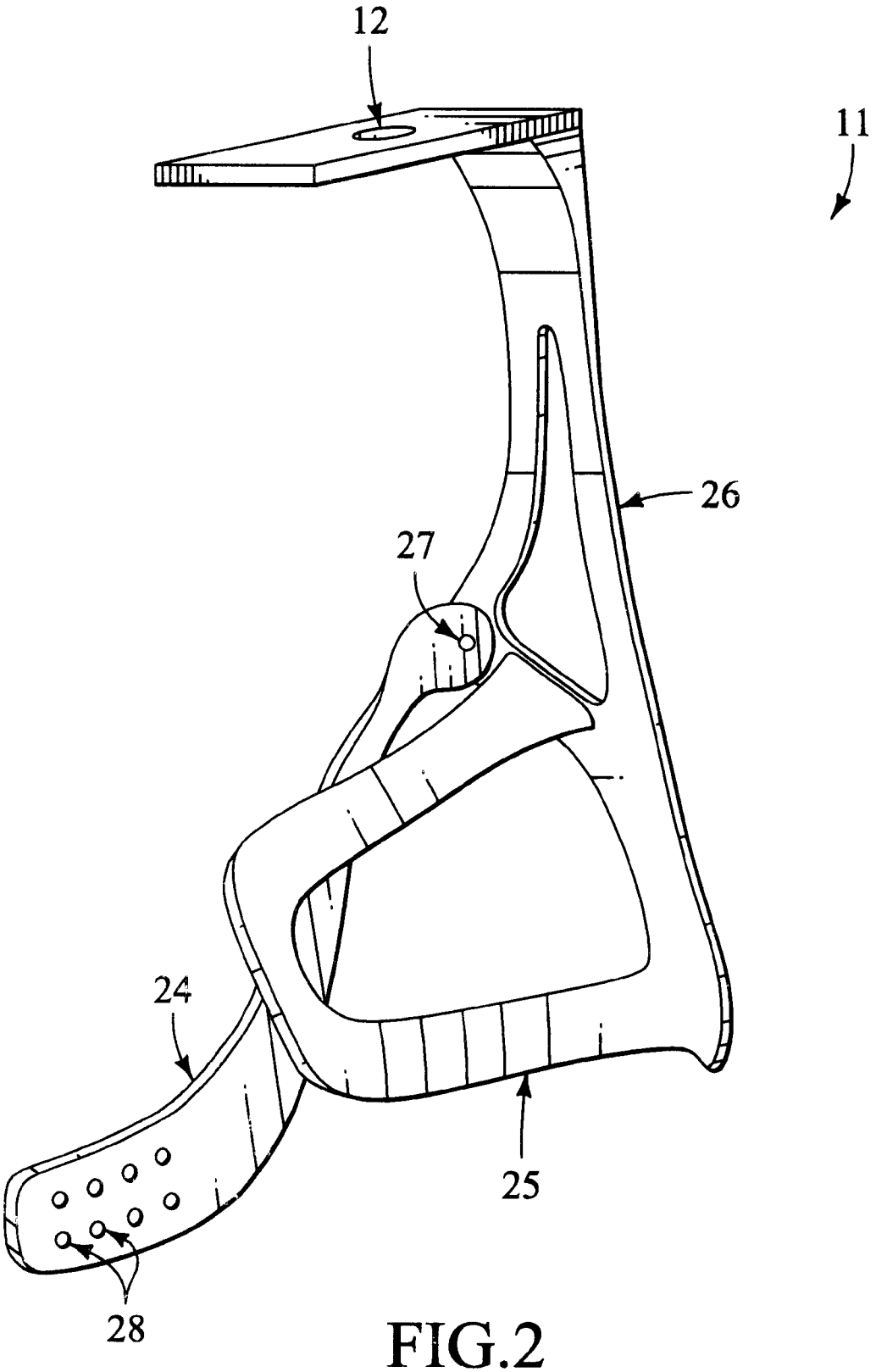
FIG. 2 is a detailed perspective view of the yoke of the golf training device of FIG. 1.

With reference to FIG. 2, in a preferred embodiment, the yoke 11 comprises a front portion 24 that is intended to be disposed generally adjacent to the user's chest, a back portion 25 that is intended to be disposed generally adjacent to the user's back, and a connecting portion 26 connecting the front portion 24 and the back portion 25 and extending to an attachment point 12 that is intended to be positioned above and intermediate the user's shoulders. The yoke 11 preferably includes a linkage 27 for adjusting the distance between the front portion 24 and the back portion 25 of the yoke 11. The front portion 24 of the yoke 11 also preferably includes one or more connection points 28 for pivotally connecting an optional extensible rod 57 and coupler 61 assembly (shown in FIG. 8 and FIG. 9) to the yoke 11 proximal to the user's sternum.

The yoke 11 is used to guide the user's upper torso through the correct rotational, lateral, and vertical movements during a golf swing. Accordingly, it is preferably constructed of a substantially rigid material, such as, for example, metal, wood, plastic, or fiberglass, that can retain its shape and resist deformation when the user exerts pressure against the yoke 11 while attempting to move in an improper manner during a golf swing. It will be appreciated that the precise configuration of the yoke 11 is not per se critical and that any configuration that is capable of comfortably engaging the upper torso of the user and guiding and coordinating the user's movements during a golf swing could be used. For example, in an alternative embodiment the yoke 11 could comprise a fabric vest to be worn by a user that has a substantially rigid extension piece stitched into the back. In such an alternative embodiment, the rigid extension piece would include an attachment point 12 located above and intermediate the user's shoulders.

Figure 3:
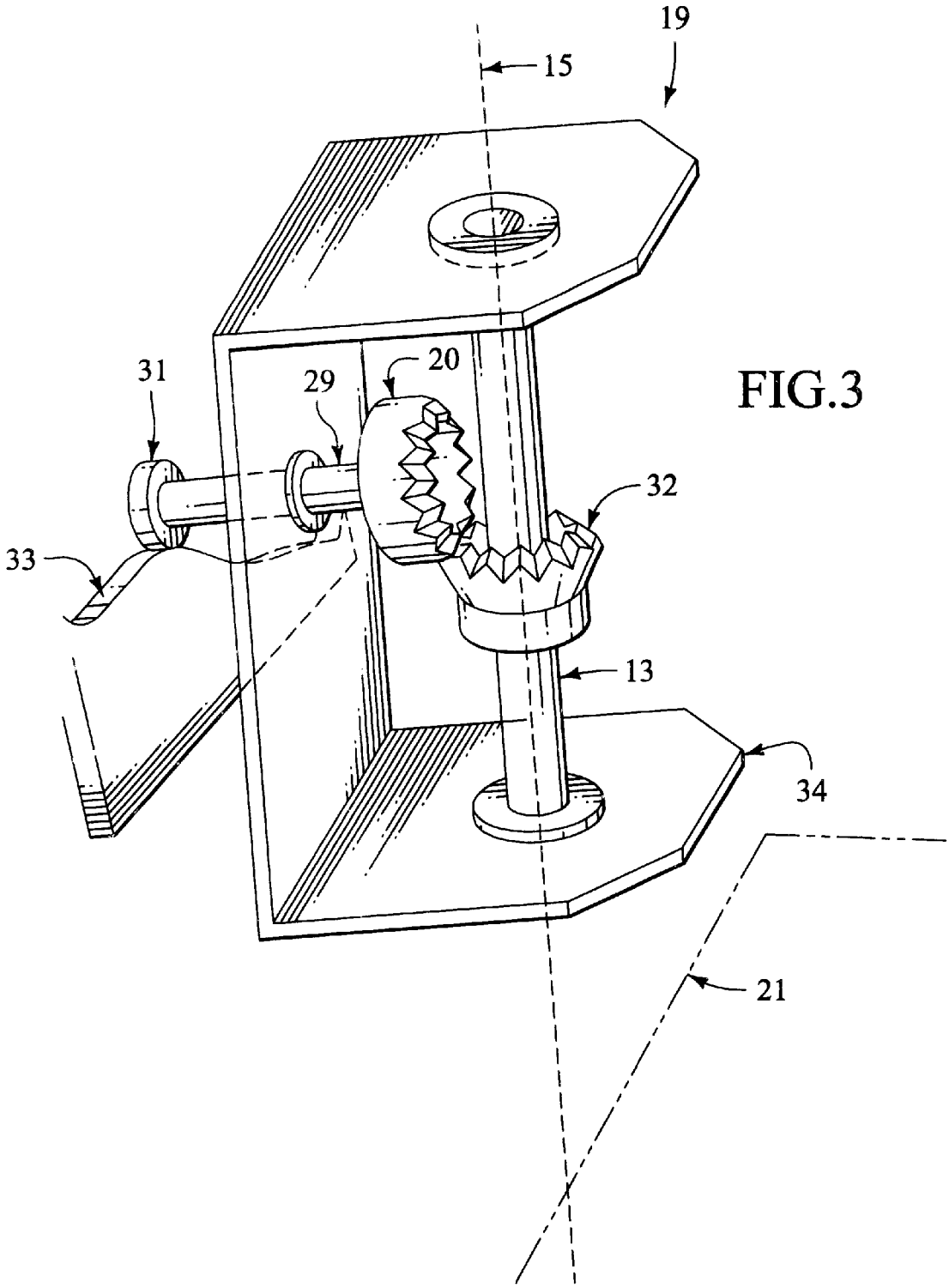
FIG. 3 is a detailed perspective view of a portion of the guide assembly of the golf training device of FIG. 1 taken from a different perspective.
Figure 4:
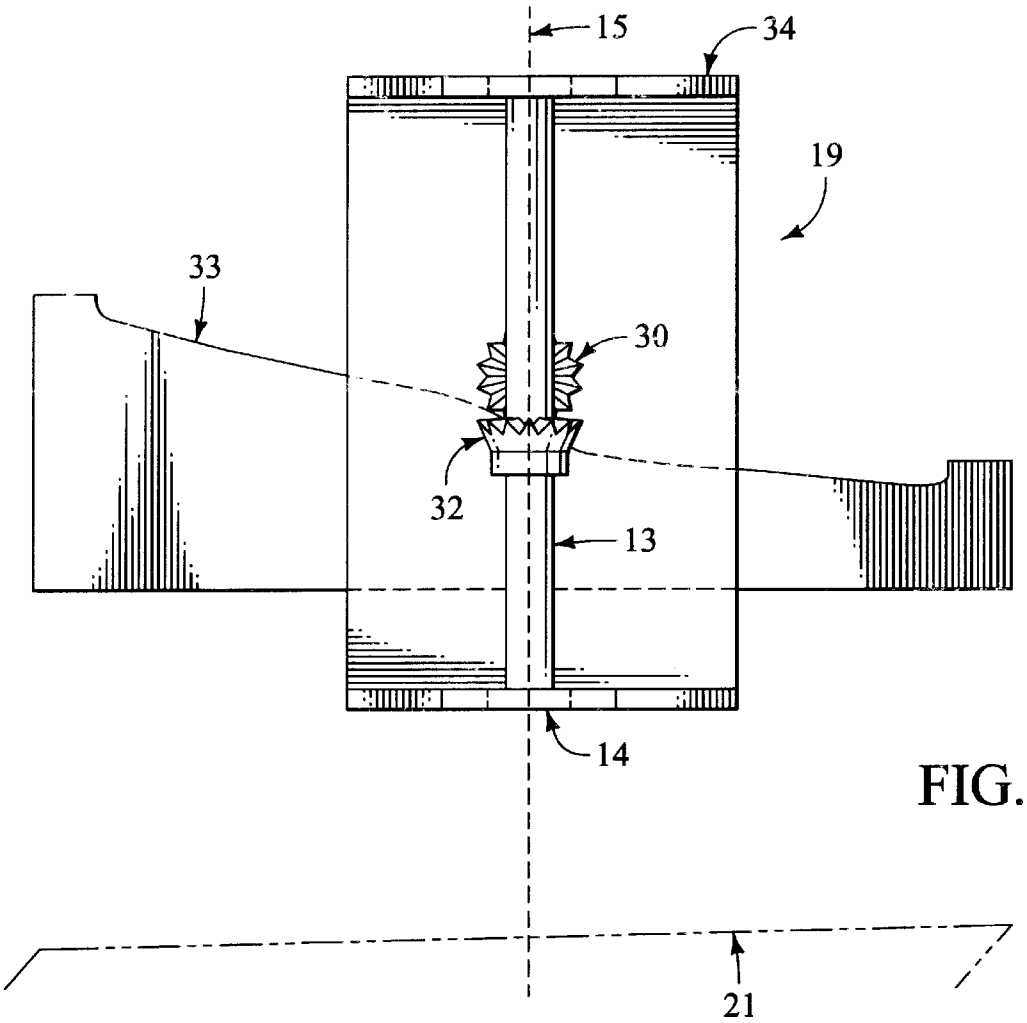
FIG. 4 is a front elevational view of the portion of the guide assembly of FIG. 3.

With reference to FIG. 3 and FIG. 4, the guide assembly 19 comprises: a shaft 29, a camming surface 33 and a generally C-shaped housing 34. The shaft 29 is journaled for rotation on a substantially horizontal axis and has a first bevel gear 30 fixedly attached at one end and a cam follower 31 attached at the other end. The first bevel gear 30 meshes with a second bevel gear 32 that is attached to the rotatable member 13. The axis of the second bevel gear 32 is the same as the axis of rotation 15 of the rotatable member 13. The camming surface 33 is engaged by the cam follower 31. The generally C-shaped housing 34 journals the shaft 29 and the rotatable member 13 in a fixed orientation relative to each other. The guide assembly 19 causes the rotatable member 13 to simultaneously rotate and move laterally away from and toward the target and also toward or away from the horizontal plane 21 as the cam follower 31 rolls along in contact with the camming surface 33.

Preferably, the camming surface 33 causes the rotatable member 13 to move laterally approximately 4.0 inches in a direction away from the target and approximately 0.75 inches toward the horizontal plane 21 while the rotatable member 13 rotates up to about 90° on the axis of rotation 15 as the user executes a back swing. The camming surface 33 also preferably causes the rotatable member 13 to move laterally approximately 8.0 inches in the opposite direction and approximately 2.5 inches away from the horizontal plane 21 while the rotatable member 13 counter-rotates up to about 180° on the axis of rotation 15 as the user executes a down swing and follow through. It will be appreciated that by changing the shape and/or length of the camming surface 33, changes can be made in the amount of lateral and vertical movement permitted during the golf swing. Preferably, the camming surface 33 has a generally smooth arcuate profile that is relatively flat (i.e., generally parallel to the horizontal plane 21) where the cam follower 31 contacts the camming surface 33 during that portion of the golf swing where user would strike the golf ball with the golf club (i.e., the bottom of the down swing).

Figure 5:
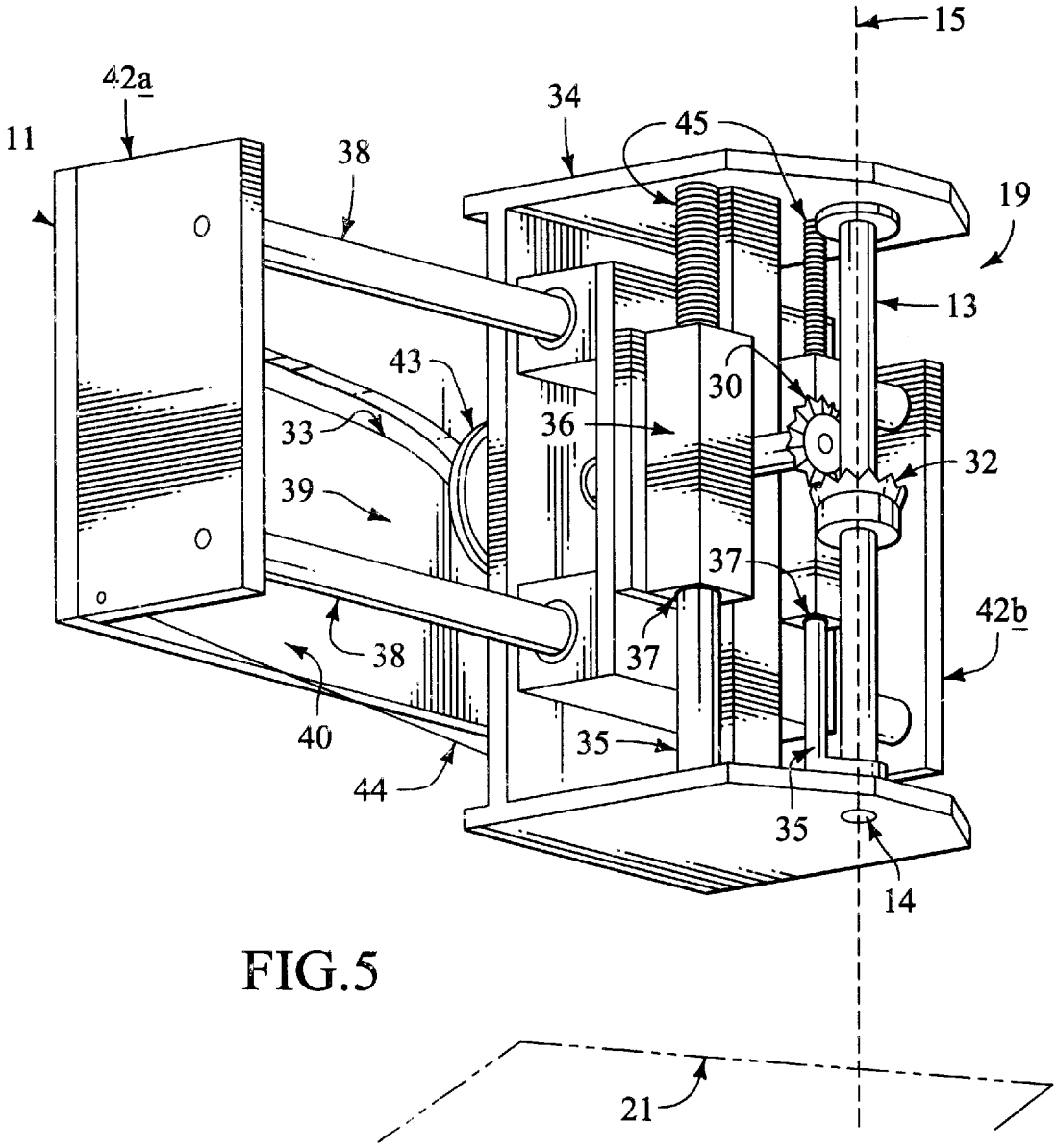
FIG. 5 is a detailed perspective view of the guide assembly of FIG. 3 and FIG. 4.

FIG. 5 provides a more detailed view of the guide assembly 19. The guide assembly 19 further comprises a pair of first rails 35, a carriage assembly 36, a plate 39, a pair of opposing rail mounts 42*a*, 42*b*, a drum 43, and a cable 44. The pair of first rails 35 are mounted within the generally C-shaped housing 34 so as to extend generally parallel to the axis of rotation 15 of the rotatable member 13. The carriage assembly 36 includes a pair of first bushings 37 that guide and slidably support the pair of first rails 35. The carriage assembly 36 rides on and is supported by a pair of second rails 38 that extend generally perpendicular to the axis of rotation 15 of the rotatable member 13 and that extend generally parallel to the target line 17. Although a pair of first rails 35 and a pair of second rails 38 are shown, a single first rail 35 and/or a single second rail 38 may be used in each instance. The plate 39 has a front surface 40 and a rear surface 41. The front surface 40 of the plate 39 includes a camming surface 33 for engagement by the cam follower 31. The camming surface 33 thus defines and limits the movement of the rotatable member 13 laterally and with respect to the horizontal plane 21. The pair of opposing rail mounts 42*a*, 42*b*, project from the front surface 40 of the plate 39. The pair of second rails 38 are mounted between the pair of opposing rail mounts 42*a*, 42*b* in a fixed relationship generally parallel to the front surface 40 of the plate 39. The drum 43 is mounted concentrically on the shaft 29. The cable 44 extends between the pair of opposing rail mounts 42*a*, 42*b* and makes frictional contact with the drum 43. The friction between the cable 44 and drum 43 causes the shaft 29 to rotate in relation to the movement of the cam follower 31 along the camming surface 33.

Springs 45 are placed around the pair of first rails 35 between the housing 34 and the carriage assembly 36 to provide for smooth operation of the guide assembly 19. Preferably, the springs 45 provide sufficient resistance to urge the yoke 11 to seek the address position when the golf swing training device is not in use, but also have sufficient compressibility to permit the rotatable member 13 to easily move toward and away from the horizontal plane 21 during the golf swing. When the yoke 11 is properly balanced using springs 45 in this manner, the user does not feel the weight of the yoke 11 or any appreciable resistance when executing a golf swing using the golf swing training device according to the present invention.

Figure 6:
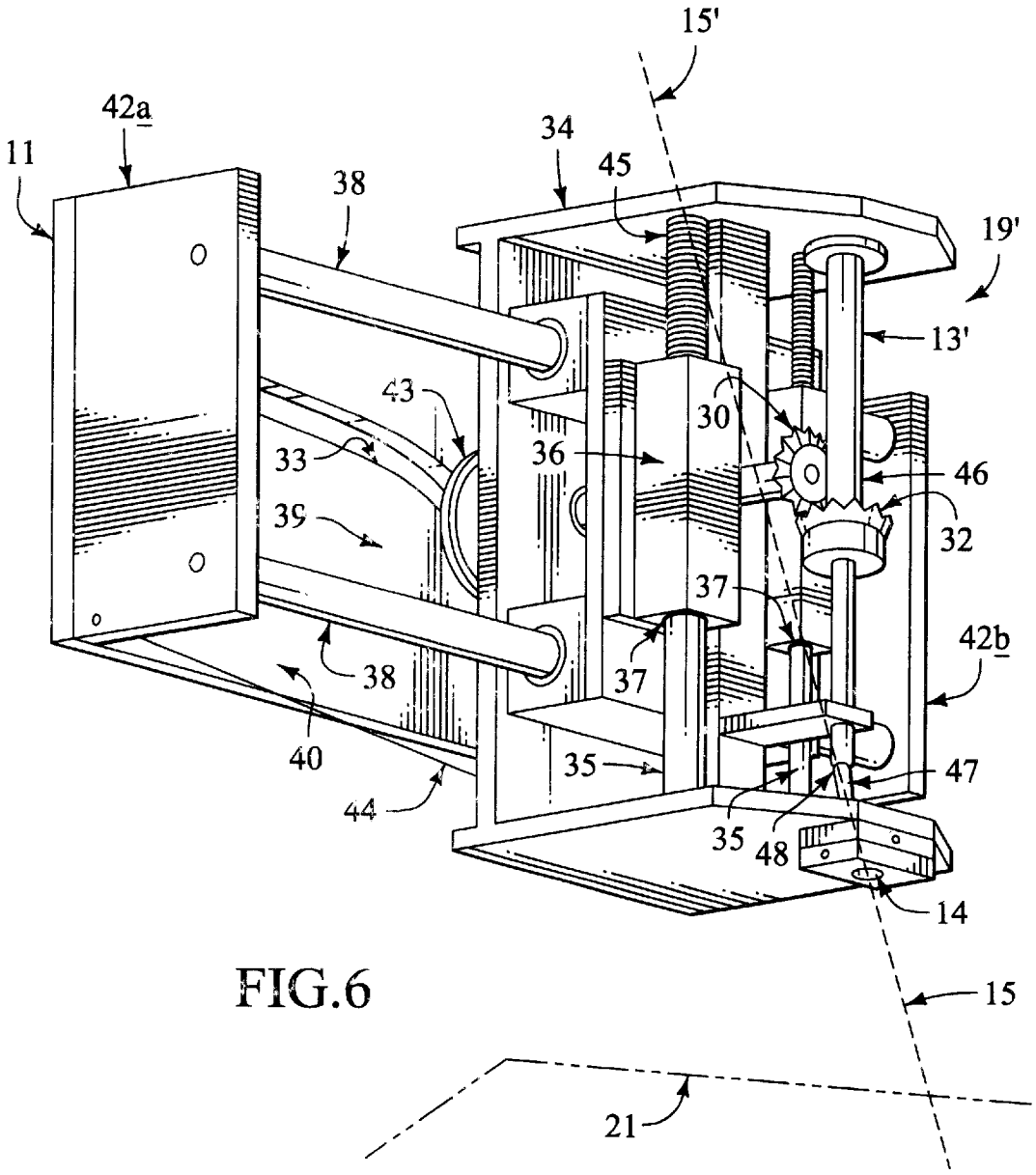
FIG. 6 is a detailed perspective view similar to FIG. 5 of another preferred embodiment of a guide assembly according to the present invention.

Another more preferred embodiment of the guide assembly 19' is depicted in FIG. 6. In this embodiment, the rotatable member 13' comprises an upper section 46 and a lower section 47 that are connected to each other, such as by a U-joint 48. The axis of rotation 15' of the lower section 47 of the rotatable member 13' can be adjusted to suit the spine and tilt angle of the user and then fixed prior to use while at the same time keeping the axis of rotation of the upper section 46 generally perpendicular to the horizontal plane 21. Preferably, the second bevel gear 32 is axially disposed with the upper section 46 of the rotatable member 13'.

In the guide assembly 19' of FIG. 6, the vertical movement of the rotatable member 13' relative to the horizontal plane 21 during the golf swing is determined by the preferably vertical orientation of the longitudinal axis of the pair of first rails 35, and not by the axis of rotation 15' of the lower section 47 of the rotatable member 13', which may deviate from vertical (such as when the first angle 20 and/or the second angle 22 are other than 90°). This configuration of the guide assembly 19' is presently more preferred because the upward and downward movement of the user relative to the horizontal plane 21 during the golf swing can be maintained in a vertical plane irrespective of the orientation of the axis of rotation 15' of the lower section 47 of the rotatable member 13'. In contrast, when the guide assembly 19 is configured as shown in FIG. 5, the upward and downward movement of the user relative to the horizontal plane 21 deviates from vertical as defined by the first angle 20 and second angle 22.

It will be appreciated that the golf swing training device 10 according to the present invention can be configured for use by right-handed and left-handed golfers simply by reversing the movements defined by the camming surface 33. Preferably, the guide assembly 19 is constructed from a rigid and durable material such as aluminum, steel, or plastic. It will be appreciated that there are a multitude of possible configurations for the guide assembly 19 that can accomplish the intended function of guiding and coordinating the movement of the rotatable member 13 as it simultaneously rotates and moves laterally and vertically when a user executes a golf swing.

Figure 7:
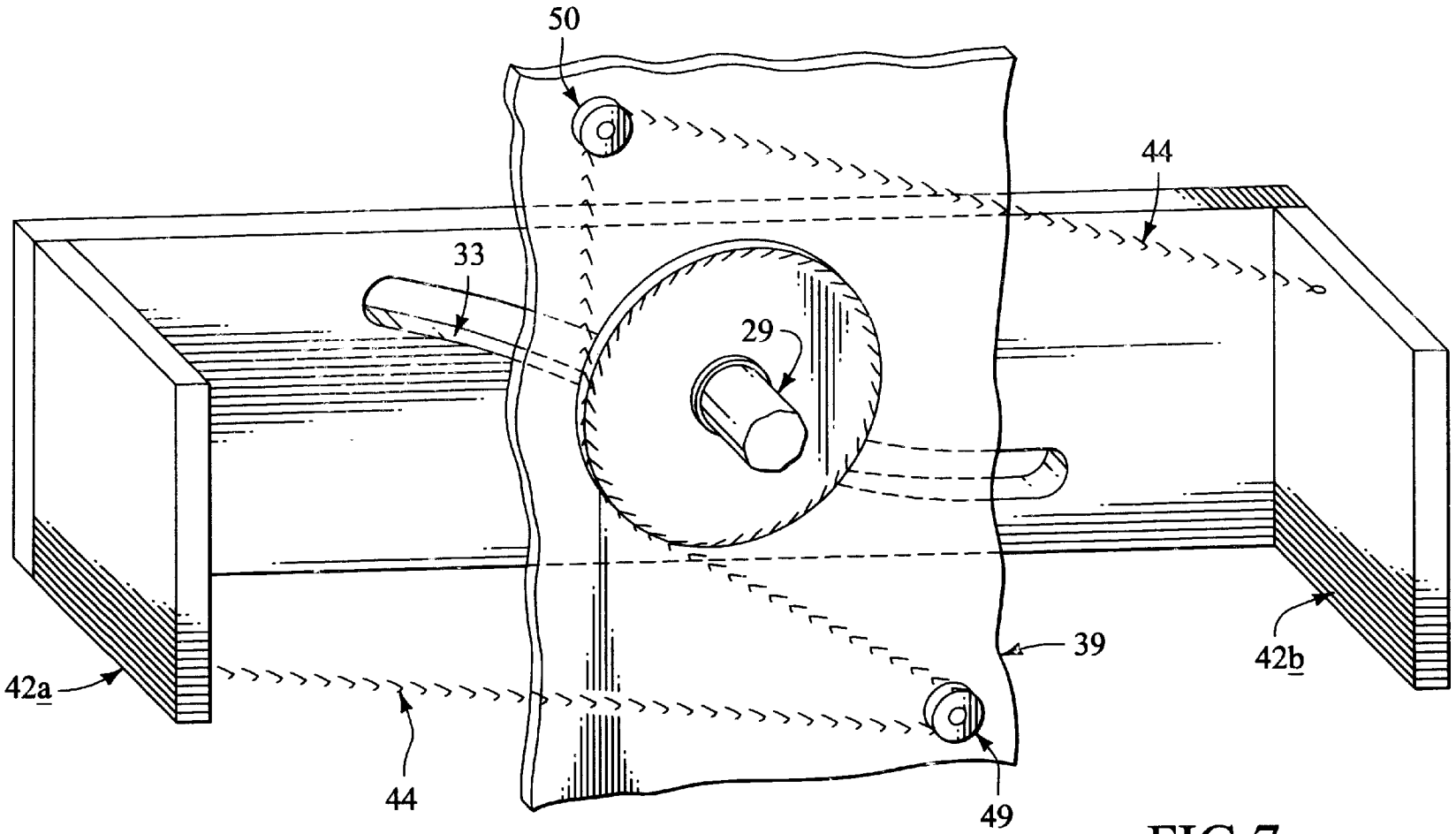
FIG. 7 is a perspective view of another portion of the guide assembly comprising the drum and cable system of the golf training device of FIG. 1.

The configuration of the drum 43 and cable 44 system used in the guide assemblies 19 and 19' illustrated in FIG. 5 and FIG. 6 is shown in greater detail in FIG. 7. One end of the cable 44 is attached to one of the opposing rail mounts 42*a* and extends laterally generally parallel to the front surface 40 of the plate 39 and bends around a first bearing 49 that is mounted on the carriage assembly 36 on the opposite side of the shaft 29 from the other rail mount 42*b*. The cable 44 then extends to and wraps clockwise completely around the drum 43 and then extends to and bends around a second bearing 50 that is mounted on the carriage assembly 36 on the opposite side of the shaft 29 as the first bearing 49. The cable 44 then extends from the second bearing 50 and is attached to the other rail mount 42*b*. As noted above, the friction between the cable 44 and drum 43 causes the shaft 29 to rotate in relation to the movement of the cam follower 31 along the camming surface 33.

The diameter of the drum 43 determines the degree of rotation of the shaft 29 in relation to the movement of the cam follower 31 along the camming surface 33. A larger drum 43 will not rotate as many degrees as a smaller drum 43 in relation to the same distance traversed by the cam follower 31 along the camming surface 33. Preferably, the diameter of the drum 43 used in the device will cause the shaft 29 to rotate 90° during the user's back swing and 180° in the opposite direction as the user executes a down swing and follow through. It will be appreciated that the drum 43 can have an eccentric shape so as to cause the rotatable member 13 to rotate more or less during the back swing than during the follow through. It will be appreciated that belts or chains can easily be substituted for the cable 44.

Although a cable 44 and drum 43 system as shown is preferred, it will be appreciated that there are a number of alternative embodiments that could equivalently accomplish the function of the cable 44 and drum 43 system within the scope of the present invention. For example, a rack and pinion arrangement could be used in which the camming surface 33 could be provided with a number of teeth that mesh with teeth in the cam follower 31 causing the shaft 29 to rotate. Alternatively, the cam follower 31 could be made of a material such as rubber that could frictionally engage the camming surface 33 and cause the shaft 29 to rotate. It will be appreciated that the mechanism that causes the shaft 29 to rotate is not per se critical to the invention, and that any method of coordinating the rotation of the shaft 29 relative to the movement of the cam follower 31 against the camming surface 33 would be suitable.

With reference to FIG. 1, in a preferred embodiment, the golf swing training device 10 according to the present invention further comprises a base 51 and at least one upright 52 connected to and extending from the base 51. The upright 52 is connected to the rear surface 41 of the plate 39 to support the guide assembly 19 in the appropriate orientation relative to the user. In an alternative embodiment, the guide assembly 19 could be supported by being mounted to a wall, by being hung from a ceiling or other overhead structure, or by being attached to some other support structure. Upright 52 has a generally horizontally extending arm 52*a*. The guide assembly 19 is mounted on the end of the arm 52*a* by attachment of the rear surface of the plate 39. The height of the arm 52*a* above the base 51 is preferably adjustable by means located at the junction of the upright 52 and the arm 52*a*.

In the preferred embodiment, the upright 52 permits the first angle 20, the second angle 22, and the distance between the rotatable member 13 and the horizontal plane 21 to be adjusted before the user executes a golf swing. Alternatively, the guide assembly 19 could be configured such that the first angle 20, the second angle 22, and the distance between the rotatable member 13 and the horizontal plane 21 could be adjusted before the user executes a golf swing. It will be appreciated by those having skill in the art that such adjustability can easily be built into the housing 34 of the guide assembly 19.

With reference to FIG. 1, the golf swing training device 10 according to the present invention can also optionally include a brace 53 connected to and extending from the base 51. The brace 53 makes contact with and limits the movement of at least one of the user's legs as the user executes a golf swing. In a preferred embodiment, the lateral position of the brace 53 can be adjusted by inserting brace pins 54 into one of a line of corresponding brace pin receiving holes 55 provided laterally in the base 51. Additionally, the height and orientation of the brace 53 can be adjusted using a pivoting clamp assembly 56. It will be appreciated that the brace 53 need not be connected to the base 51, but could be a free standing structure independent of the base 51.

Figure 8:
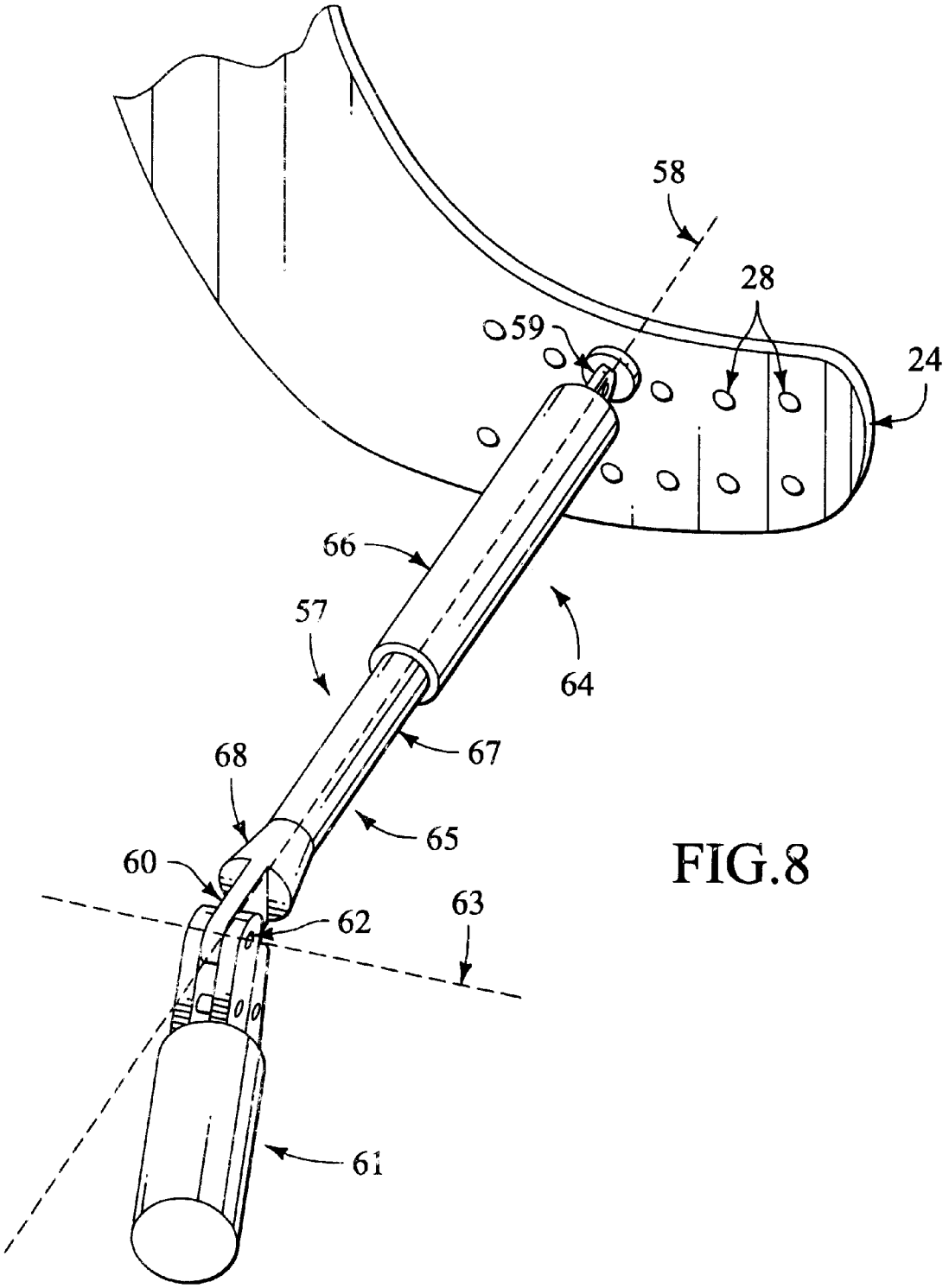
FIG. 8 is a detailed perspective view of the extensible rod and coupler assembly according of the golf training device of FIG. 1.

With reference to FIG. 8, the golf swing training device 10 according to the present invention also optionally comprises an extensible rod 57, a coupler 61, and a hinge 62. The extensible rod 57 has a longitudinal axis 58, a first end 59, and a second end 60. The first end 59 of the extensible rod 57 is pivotally connected to a connection point 28 the front portion 24 of the yoke 11 that is intended to be proximal to the user's sternum. The coupler 61 attaches to the grip end of the golf club. The hinge 62 connects the coupler 61 to the second end 60 of the extensible rod 57. The hinge 62 has a pivot axis 63 that is disposed generally perpendicular to the longitudinal axis 58 of the extensible rod 57. Preferably, the pivot axis 63 is disposed such that it is near the center line of a right-handed user's left wrist (reversed for a left-handed user) when the golf swing training device 10 is being used. This location of the pivot axis 63 ensures that the user's wrist maintained is in the correct position throughout the golf swing.

Figure 9:
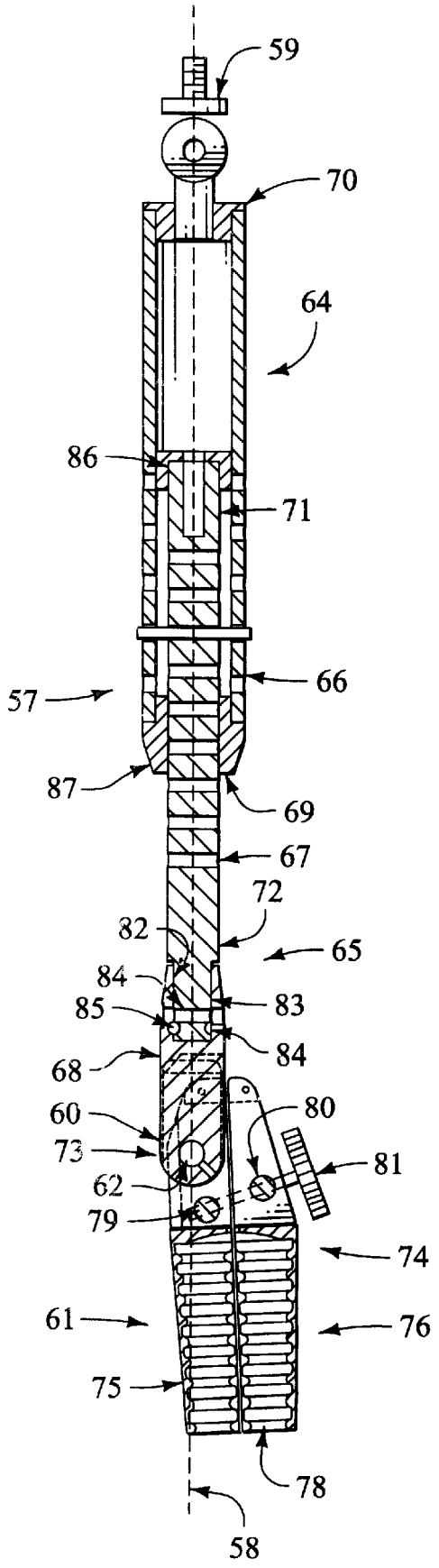
FIG. 9 is a side elevational view of the extensible rod and coupler assembly of FIG. 8.

In a preferred embodiment the extensible rod 57 comprises an upper portion 64 terminating in the first end 59 and a lower portion 65 terminating in the second end 60. The upper portion 64 and the lower portion 65 are slidably connected so as to permit movement relative to each other along the longitudinal axis 58. With particular reference to FIG. 8 and FIG. 9, in the most preferred embodiment, the extensible rod 57 comprises several sub-components that cooperate to make the extensible rod 57 variable in terms of its length along the longitudinal axis 58 and that provide for selective range of motion about the pivot axis 63 as well as selective range of rotation of the upper portion 64 relative to the lower portion 65 on the longitudinal axis 58. In the most preferred embodiment illustrated in FIG. 8 and FIG. 9, the upper portion 64 of the extensible rod 57 comprises a tubular upper section 66, and the lower portion 65 of the extensible rod 57 comprises a cylindrical middle section 67 and a lower section 68. The tubular upper section 66 has an open end 69 and a closed first end 70. The closed first end 70 of the extensible rod 57 is pivotally connected to the front portion 24 of the yoke 11 proximal to the user's sternum. The cylindrical middle section 67 has one end 71 disposed within the open end 69 of the tubular upper section 66 and another end 72 rotatably connected to the lower section 68 such that the rotational axis is coincident to the longitudinal axis 58 defined by the extensible rod 57. The cooperation of the various sub-components that comprise the extensible rod 57 are discussed below.

As can be seen in greater detail in FIG. 8 and FIG. 9, the portion of the lower section 68 which terminates in the second end 60 includes a tongue portion 73 that fits into a slot defined by the space between opposing hinge plates 77 in the coupler 61 as discussed in detail below. The tongue portion 73 is connected to the coupler 61 by a hinge 62 having a pivot axis 63 which is perpendicular to the longitudinal axis 58 of the extensible rod 57. The opposite end of the lower section 68 includes a cylindrical bore 82 along the longitudinal axis 58.

One end of the middle section 67 terminates in a cylindrical post 83 which is provided with a circumferential race 84, which may also be referred to as a channel or a groove. The post 83 slides into the cylindrical bore 82 in the lower section 68. A clevis 85 passes through an opening in the lower section 68 so as to engage the race 84 and prohibit the removal of the post 83 from the cylindrical bore 82 in the lower section 68 while permitting the lower section 68 to rotate on the longitudinal axis 58 relative to the middle section 67. Attached to the end of the middle section 67 opposite the post 83 is a second bushing 86.

The upper section 66 comprises a tube having an open end 69 and a closed first end 70. The middle section 67 slides into the open end 69 of the tubular upper section 66 and rides on the interior walls of the tube on the second bushing 86. The length of the extensible rod 57 can be varied along the longitudinal axis 58 by sliding the middle section 67 relative to the upper section 66. Preferably, the orientation of the middle section 67 within the upper section 66 is maintained by a threaded collar piece 87 which attaches to the open end 69 of the upper section 66. The threaded collar piece 87 also prevents the middle section 67 from being withdrawn from the upper section 66. The closed first end 70 of the upper section 66 terminates in the first end 59. Preferably, the entire extensible rod 57 is constructed of aircraft aluminum except for the second bushing 86 and the collar piece 87, which are preferably constructed of brass. However, the extensible rod 57 could be constructed of virtually any rigid material. A locking pin 88 can be selectively inserted into an opening through the lower section 68 and the post 83 to restrict rotation of the lower section 68 relative to the middle section 67 when desired.

It will be appreciated that there are a multitude of possible configurations for the extensible rod 57 which would be suitable for the invention. For example, the extensible rod 57 need not be linear in configuration, but could include some degree of curvature. If the extensible rod 57 does include curvature, the longitudinal axis 58 would be defined as the line running from the first end 59 to the second end 60. For practicing certain attributes of the golf swing, the extensible rod 57 could further include a stop (not illustrated) for limiting the range of rotation of the cylindrical middle section 67 relative to the lower section 68. Additionally, it will be appreciated that the functionality of the extensible rod 57 could be accomplished using configurations featuring components other than illustrated in the preferred embodiment.

Figure 10:
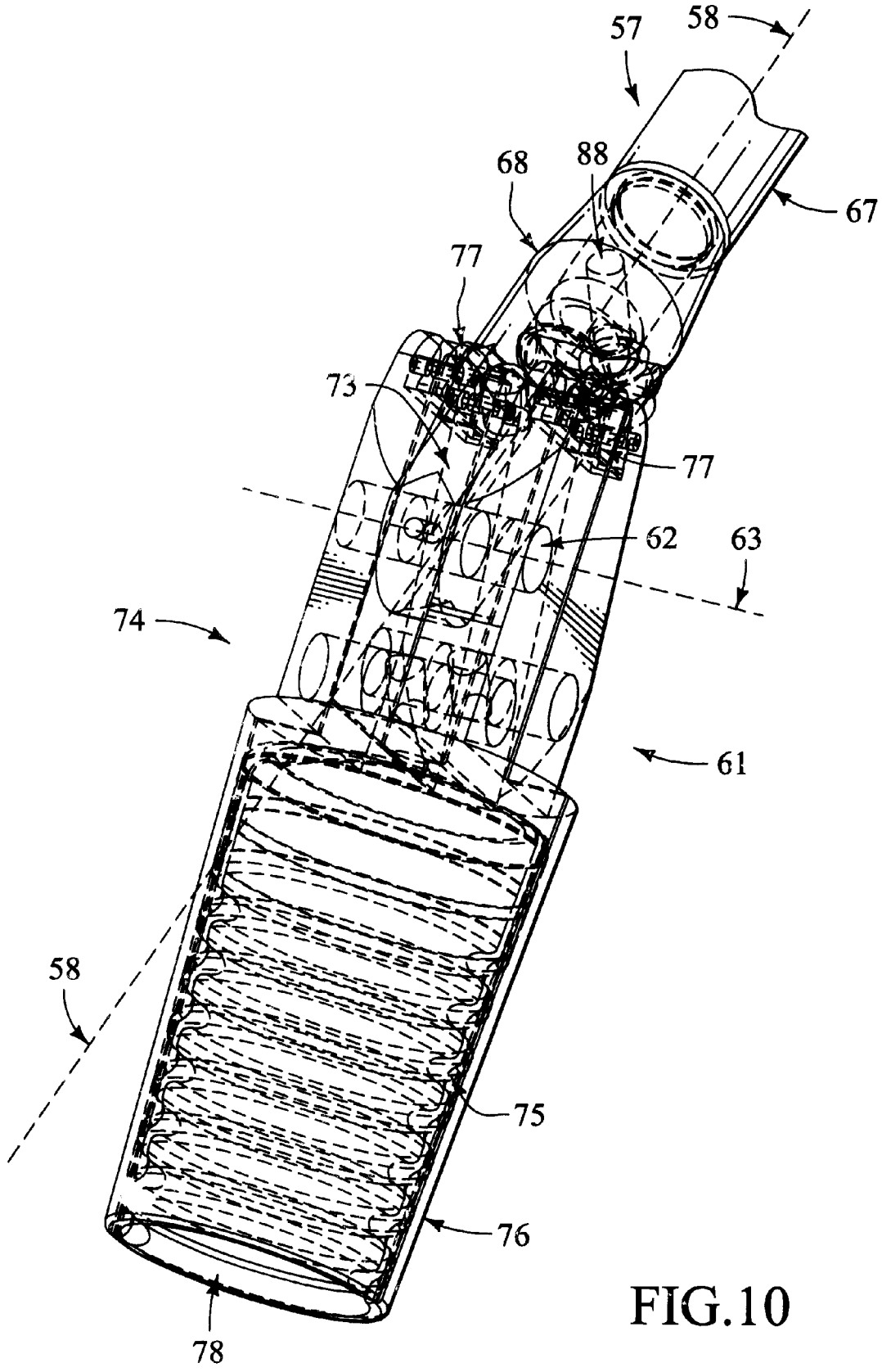
FIG. 10 is a detailed perspective view of the coupler of the assembly of FIG. 8 and FIG. 9.

With reference to FIG. 10, in a preferred embodiment the coupler 61 comprises an alligator clamp assembly 74 that is connected to the tongue portion 73 of the lower section 68 of the extensible rod 57 by a hinge 62. The hinge 62 has a pivot axis 63 that is disposed perpendicular to the longitudinal axis 58 of the extensible rod 57. In a preferred embodiment, the hinge 62 further includes a spring-loaded detent element which bears against the hinge 62 and emits an audible click as the coupler 61 rotates on the pivot axis 63 relative to the extensible rod 57.

With particular reference to FIG. 10, in the most preferred embodiment, the coupler 61 of the golf swing training device 10 according to the present invention comprises an upper jaw 75 and a lower jaw 76 which are each separately connected on one end to a pair of opposing hinge plates 77 to form an alligator clamp assembly 74 that is capable of clamping onto the grip end of golf clubs of all conventional sizes. The space between the opposing hinge plates 77 defines a slot. The interior portion of the ends of the upper jaw 75 and the lower jaw 76 opposite the hinge plates 77 are preferably provided with ridges 78 which are oriented so as to frictionally engage the grip end of a golf club when the upper jaw 75 and the lower jaw 76 of the alligator clamp assembly 74 are pressed toward each other. The ridges 78 act as blunt teeth which bite into but do not damage the resilient materials from which the grips of golf clubs are commonly formed, such as leather and rubber. Preferably, the upper jaw 75 and lower jaw 76 can frictionally engage no more than about the last 2 inches of the grip end of a golf club, leaving a substantial portion thereof available for the user to grip when using the device. The upper jaw 75 and lower jaw 76 are preferably formed from rigid plastic or aircraft aluminum and have a slim profile so as to permit the user to take a comfortable grip on the golf club when using the device, even if part of the grip is taken over a portion of the upper jaw 75 and lower jaw 76.

In the illustrated embodiment shown in FIG. 9, the upper jaw 75 is provided with an upper pin 79 which is bisected at its midpoint by a threaded bore. The lower jaw 76 is provided with a lower pin 80 which is bisected at its midpoint by a smooth bore which is slightly larger in diameter than the threaded bore. The threaded end of a clamping pin 81 passes through the smooth bore and engages the threaded bore. When the threaded end of the clamping pin 81 is screwed into the threaded bore, the head of the clamping pin 81 presses against the lower jaw 76 which causes the upper jaw 75 and the lower jaw 76 of the alligator clamp assembly 74 to become pressed toward each other and securely attach the coupler 61 to the grip end of a golf club.

It will be appreciated that the preferred configuration of the coupler 61 describe above is but one possible configuration which would be suitable for use in the invention and that other configurations for the coupler 61 can be used. For example, the coupler 61 could comprise a socket formed of a resilient material which slides over and frictionally engages the grip end of a golf club. Alternatively, the coupler 61 could comprise a rigid collar sized to easily slide over the grip end of a golf club and be attachable thereto using threaded fasteners which press against the grip end of the golf club as they are tightened. Essentially, any configuration which includes means for securely attaching the coupler 61 to the grip end of a golf club and a source for permitting the coupler 61 to be connected to the second end 60 of the extensible rod 57 by a hinge 62 would be suitable.

Preferred Method of Using the Device

The golf swing training device 10 according to the present invention can be used with or without a golf club, with or without a golf ball, with or without the optional extensible rod 57 and coupler 61 assembly, and with or without the optional brace 53. Even when the device is used without a golf club, a golf ball, the optional extensible rod 57 and coupler 61 assembly, and the optional brace 53, a user nevertheless obtains substantial benefit simply by using the device to practice the rotational, lateral, and vertical movements involved in executing a proper golf swing. The golf swing training device 10 according to the present invention guides and coordinates the user's body position and lateral, vertical and rotational movement so that after executing several golf swings using the device, a user's muscles become accustomed to making the movements of a proper golf swing.

To use the golf swing training device 10 according to the present invention without a golf club, golf ball, the optional extensible rod 57 and coupler 61 assembly, and the optional brace 53, a user first comfortably positions his or her upper torso in the yoke 11. In a preferred embodiment, the yoke 11 includes a front portion 24 that is intended to be disposed generally adjacent to the user's chest, a back portion 25 that is intended to be disposed generally adjacent the user's back, and a connecting portion 26 connecting the front portion 24 and the back portion 25 and extending to an attachment point 12 that is intended to be positioned above and intermediate the user's shoulders. With his or her upper torso positioned in and engaged in the yoke 11, the user takes a comfortable stance a distance away from and facing a predetermined point 18 where a golf ball would be placed. The user's feet should preferably be placed generally parallel to the target line 17 and astride an imaginary horizontal line perpendicular to the target line 17 that passes through the predetermined point 18 on which a golf ball would be placed. Although the position of the user's arms and hands is not critical, preferably the user's arms are extended away from his or her body in the direction of the predetermined point 18 where the golf ball would be placed, with the user's hands lightly clasped together as if the user were holding a golf club. The user is now in the address position.

The user begins the golf swing by rotating his or her hips and upper torso away from the intended target while simultaneously moving his or her arms away from the predetermined point 18 where the golf ball would be placed. This first part of the golf swing is called the back swing. During the back swing portion of the golf swing, the golf swing training device 10 according to the present invention guides and coordinates the user's body position and rotational, lateral, and vertical movement. The yoke 11 guides the user's upper torso through the proper positions during the golf swing, allowing the user's shoulders to rotate preferably up to about 90° away from the target from the address position while simultaneously allowing the axis on which the user's upper torso is rotating to move laterally away from the target a few inches and toward the horizontal plane 21. The yoke 11 prevents the user from moving his or her upper torso into an incorrect position during the back swing.

At the top of the back swing, the user's shoulders have preferably rotated away from the target to a position that is about 90° from the address position. It will be appreciated that some users of the golf swing training device 10 according to the present invention will not have the flexibility to rotate their shoulders 90° from the address position. However, because the golf swing training device 10 according to the present invention coordinates and guides the user's body position and lateral, vertical, and rotational movements during the golf swing, at whatever degree of rotation the user is able to accomplish, the device will maintain the user's body in the proper relative position. It will be appreciated that through use of the device, some users will develop the flexibility needed to execute a full 90° rotation, which is sometimes called a turn. The device promotes a more complete body turn, rather than a twisting of the body, thereby reducing back tension.

From the top of the back swing, the user executes the down swing portion of the golf swing. The movements involved in the down swing are, in essence, the reverse of the movements involved in the back swing. During the down swing, the user's shoulders counter-rotate back toward the address position in the direction of the intended target. The golf swing training device 10 according to the present invention guides and coordinates the user's body position and lateral, vertical, and rotational movement during the down swing. The yoke 11 prevents the user's upper torso from moving in an incorrect manner, and causes the user to execute the movements involved in the down swing in a coordinated manner. During the down swing, the user's upper torso rotates back toward the address position on an axis of rotation 15 that simultaneously moves laterally in the direction of the target and away from the horizontal plane 21.

At the bottom of the down swing, the user has essentially returned to the address position. At that point, the user's movements transition into the follow through portion of the golf swing. During the follow through portion of the golf swing, the user's shoulders continue to rotate in the direction of the intended target preferably up to about 180° from the position they were at the top of the back swing and up to about 90° from the address position. Again, some users will not initially possess the flexibility needed to execute a full turn, but such flexibility can be developed through repeated use of the device. During the follow through, the user's upper torso continues to rotate toward the target on an axis of rotation 15 that simultaneously moves laterally in the direction of the target and away from the horizontal plane 21.

Through repeated swings, the user's muscles will become accustomed to executing the golf swing as guided and coordinated by the golf swing training device 10 according to the present invention. Initially, the user will most likely bear pressure against the yoke 11 in an attempt to move his or her upper body in an improper manner. However, after taking several swings with his or her upper body positioned in the yoke 11, the user will become used to the movements involved in executing a proper golf swing. After using the device for a while, the user will be able to execute the golf swing without bearing any significant pressure against the yoke 11. Using the device, the user grooves these movements, meaning that the user's muscles acquire a "muscle memory" of the proper golf swing which the user can then confidently repeat on the golf course when he or she is not using the device.

The golf swing training device 10 according to the present invention is useful for teaching novice golfers how to execute the movements involved in the golf swing. It is also useful for helping those persons who golf regularly to identify and correct swing flaws or faults that have been acquired and grooved into their golf swings over time. Because the device trains the user to execute the same movements in a coordinated manner, the device is also useful for helping golfers to quickly regain and restore their golf swings after periods of inactivity. Furthermore, because the device holds the user's upper torso in the proper position during the golf swing, the device is useful for allowing the golfer to stop and hold various positions during a golf swing while receiving instruction from a trained golf teaching professional.

In a preferred method of use, a user uses the golf swing training device 10 according to the present invention while gripping and swinging one of the user's golf clubs that are used in actual play. To use the device in this manner, the user simply takes a comfortable grip on the grip end of a golf club and places the head of the golf club near the predetermined point 18 at which a golf ball would be placed on the side opposite the intended target. The user then executes the movements involved in executing the back swing, the down swing, and the follow through while his or her upper torso is positioned in and engaged by the yoke 11.

More preferably, the user also uses a golf ball while using the device. The user places the club head next to the golf ball, which has been placed in a predetermined position on the target line 17, on the side opposite the intended target and then executes the movements involved in executing the back swing, the down swing, and the follow through while his or her upper torso is engaged in the yoke 11. At the bottom of the down swing, the user will strike the golf ball with the golf club. After practicing the golf swing using the device, the golfer will be able to see, hear, and feel a golf club striking a golf ball as the user's body position and lateral, vertical, and rotational movements are being guided and coordinated through a proper golf swing by the golf swing training device 10 according to the present invention.

The sense of touch is very important in the game of golf. It is sometimes difficult for a user to translate the feeling of a practice device to the feeling a user has while gripping the user's own playing clubs. The golf swing training device 10 according to the present invention is particularly useful because it allows the user to practice hitting golf balls while gripping his or her own playing clubs. Thus, by using the golf swing training device 10 according to the present invention, it is not necessary for the user to attempt to translate the feeling of a practice device to the feeling of the user's own playing clubs.

To use the golf swing training device 10 according to the present invention to practice a golf swing using the optional extensible rod 57 and coupler 57 assembly, a user attaches the coupler 61 to the grip end of a golf club in a manner so as to fix the pivot axis 63 of the hinge 62 generally perpendicular to the horizontal grooves in the face of the golf club. It will be appreciated that users who have mastered the basic golf swing may vary the fixed relationship between the pivot axis 63 of the hinge 62 and the horizontal grooves in the face of the golf club in order to practice special shots, such as fades or draws, where the rotation of the golf ball relative to the target line 17 is intentionally altered from perpendicular. In either event, the user takes a comfortable grip predominantly on the uncovered portion of the grip of the golf club. Because the profile of the coupler 61 is relatively slim, a portion of the golfer's grip may be on the coupler 61. The user then assumes an address position with the head of the golf club placed on the side of the golf ball opposite the intended target.

FIGS. 11–16 are a series of front elevational views of a right-handed user 89 using the golf swing training device 10 according to present invention with the optional extensible rod 57 and coupler 61 attached to the grip end of a golf club 90 to execute a golf swing. In order to demonstrate the lateral and vertical movements involved in a golf swing conducted by a user 89 of the golf swing training device 10 according to the present invention, fixed vertical reference line A—A and fixed horizontal reference line B—B have been added to FIGS. 11–16 so that the relationship between such reference lines and the attachment point 12 between the yoke 11 and the end 14 of the rotatable member 13 can be observed as the user 89 executes a golf swing.

Figure 11:
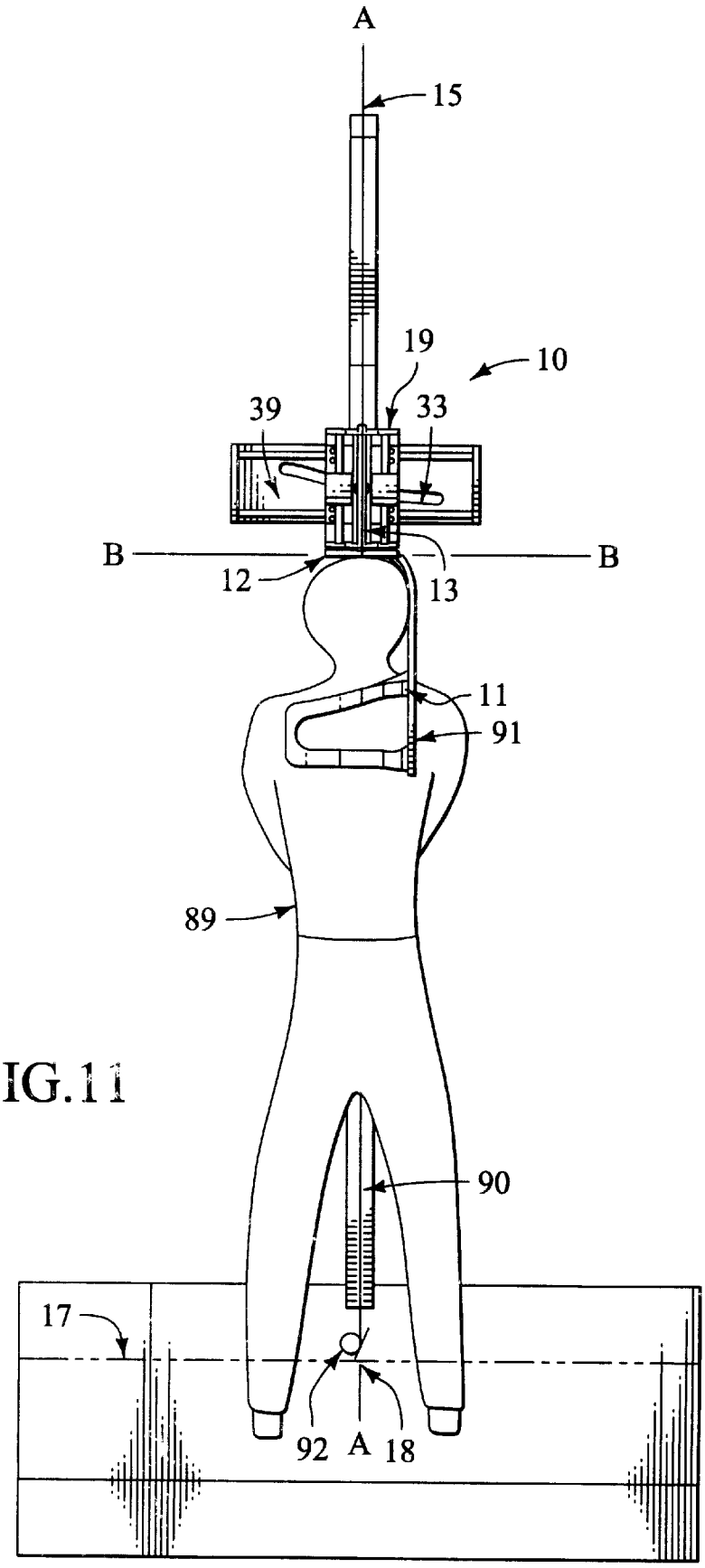
FIG. 11 is a front elevational view of the golf swing training device of FIG. 1 being used by a user who is in the address position of a golf swing.

In FIG. 11, the user 89 is facing a golf ball 92 which at rest on a predetermined point 18 on the ground. The upper torso 91 of the user 89 is positioned in and engaged by the yoke 11. Note that in FIG. 11, the fixed vertical reference line A—A and the fixed horizontal reference line B—B intersect at the attachment point 12 between the yoke 11 and the end 14 of the rotatable member 13. The attachment point 12 is positioned above and intermediate the user's shoulders. The back portion 25 of the yoke 11 stays in contact with the user's back, and in so doing keeps the attachment point 12 in the same position relative to the user's shoulders throughout the swing. Preferably, the axis of rotation 15 passes through at least a portion of the user's spine.

While in the address position, the hinge 62 permits the user to raise and lower the golf club and thereby change the lie angle between the bottom of the club head and the ground to suit the user's stance. Once a comfortable stance has been obtained, the user begins the back swing by turning the shoulders and hips which rotates the golf club away from the golf ball initially along the target line 17. One of the common swing flaws encountered by golfers is that the back swing is initially executed by the golfer lifting the head of the golf club off the ground by using the arm muscles and/or by bending the joints of the wrist and/or elbow. The extensible rod 57 coupled with the hinge 62 prevent the user from initially executing the back swing by using the arm muscles and/or by bending the joints of the wrist and/or elbow. Instead, the user learns to execute a back swing that involves rotating the user's body while simultaneously moving the upper body laterally away from the target and toward the horizontal plane 21. For a right-handed user, brace 53 (not shown in FIG. 11) can optionally be used to restrain the user's right leg from making any lateral movement while simultaneously permitting rotational movement, thereby creating a post on which the user's upper body and hips can rotate. For a left-handed user, the brace 53 is used to restrain the movement of the user's left leg.

As the user continues to execute the back swing and complete the turn away from the intended target, the extensible rod 57 attached to the yoke 11 operates to keep the user's arms moving together in the proper position relative to one another, and in relation to the user's upper body and, in particular, to the user's sternum. Another common swing flaw involves the bending of the elbows, particularly the left elbow for a right-handed golfer, which causes the golf club to get into an improper position. The extensible rod 57 keeps a right-handed user from bending the elbows in an improper manner and allows centrifugal force from the rotation to extend the user's left arm (a left-handed user's right arm would be extended). The extensible rod 57 also prevents the destruction of centripetal force, which is required to maximize club head speed created by the rotation and centrifugal force.

Figure 12:
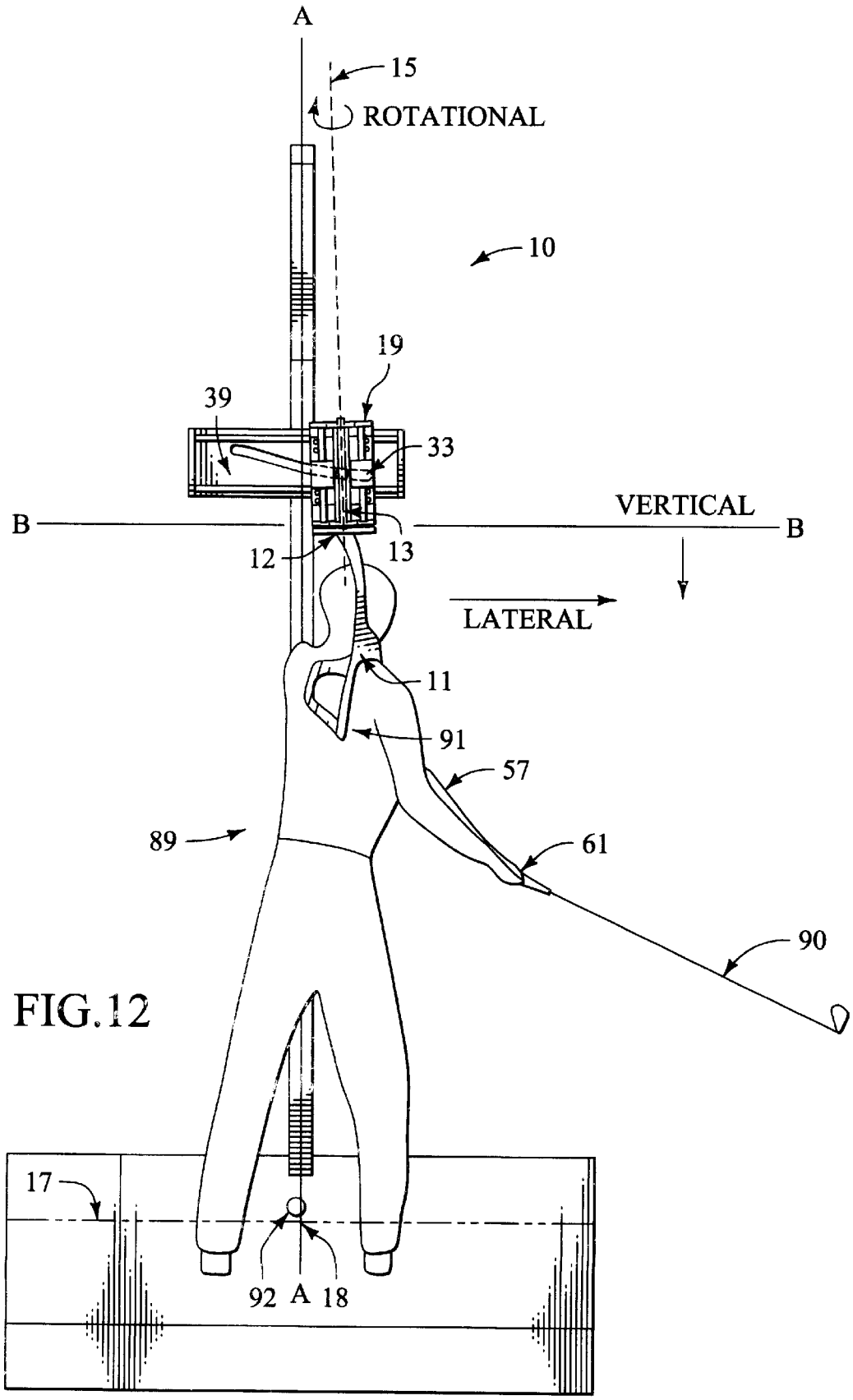
FIG. 12 is a front elevational view similar to FIG. 11 of the golf swing training device of FIG. 1 being used by a user who is in the process of executing the back swing portion of a golf swing.

FIG. 12 shows the right-handed user 89 in the process of executing a back swing while using the golf swing training device 10 according to the present invention. The upper torso 91 of the user 89 has rotated away from the intended target as the user 89 and the golf club 90 has rotated away from the golf ball 92. Note that the attachment point 12 between the yoke 11 and the end 14 of the rotatable member 13 has moved laterally away from the intersection of the fixed vertical reference line A—A in a direction away from the target and that the attachment point 12 between the yoke 11 and the end 14 of the rotatable member 13 has also moved toward the horizontal plane 21 and thus is now below the fixed horizontal reference line B—B.

As the user approaches the top of the back swing, the hinge 62 between the extensible rod 57 and the coupler 61 allows the user to cock his or her wrists in the appropriate plane at the appropriate point in the swing. By encouraging a full body turn, at the top of the back swing the golf club will preferably be oriented such that the shaft of the golf club is generally parallel to the target line 17. The left elbow joint, for a right-handed user, will be higher than the right elbow joint at the top of the back-swing. This is the correct position that comes about as the golf swing training device 10 according to the present invention guides and coordinates the user's body position and lateral, vertical, and rotational movement during the back swing.

Figure 13:
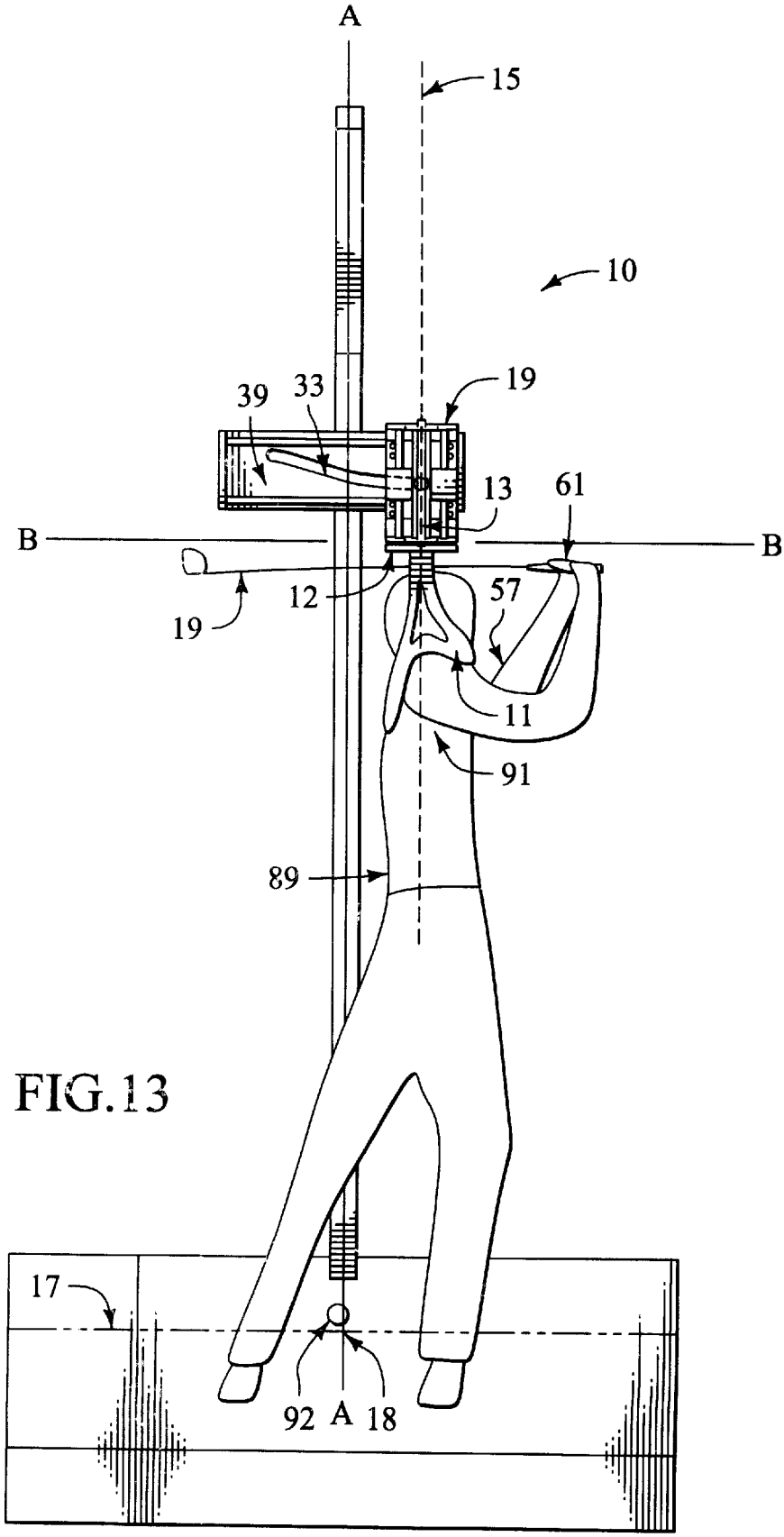
FIG. 13 is a front elevational view similar to FIG. 11 and FIG. 12 of the golf swing training device of FIG. 1 being used by a user who is in the top of the back swing position of a golf swing.

FIG. 13 shows a right-handed user 89 at the top of the back swing. At the top of the back swing, the shaft of the golf club 90 is preferably generally parallel to the target line 17. At the top of the back swing, the shoulders of the user 89 have rotated to a position that is about 90° away from the position they were in at address in a direction away from the target. During the back swing, the attachment point 12 between the yoke 11 and the end 14 of the rotatable member 13 moves away from the intended target laterally and toward the horizontal plane 21, as can be seen from its position to the right of and below the fixed vertical and horizontal reference lines A—A and B—B, respectively.

From the top of the back swing, the head of the golf club reverses direction and begins moving along a path that will eventually cause it to collide with the golf ball. This movement is generated primarily by the user's body, which has previously executed a turn in order to complete the back swing (preferably up to about 90° at the shoulders and up to about 45° at the hips or waist from the address position), turning back toward the ball. As the user's body rotates back toward the golf ball, gravity and centrifugal force cause the user's arms to move back toward the initial address position. The yoke 11 contacts the user's upper torso and guides and coordinates the user's body position and lateral, vertical, and rotational movement during the swing. Centrifugal force, which is generated by the rotation of the user's hips, upper body, and arms about the axis of rotation 15 causes the golf club head to accelerate on an arc called the swing path. The golf swing training device 10 according to the present invention keeps the swing path of the club head generally along the target line 17 when the club head is in contact with the golf ball.

Figure 14:
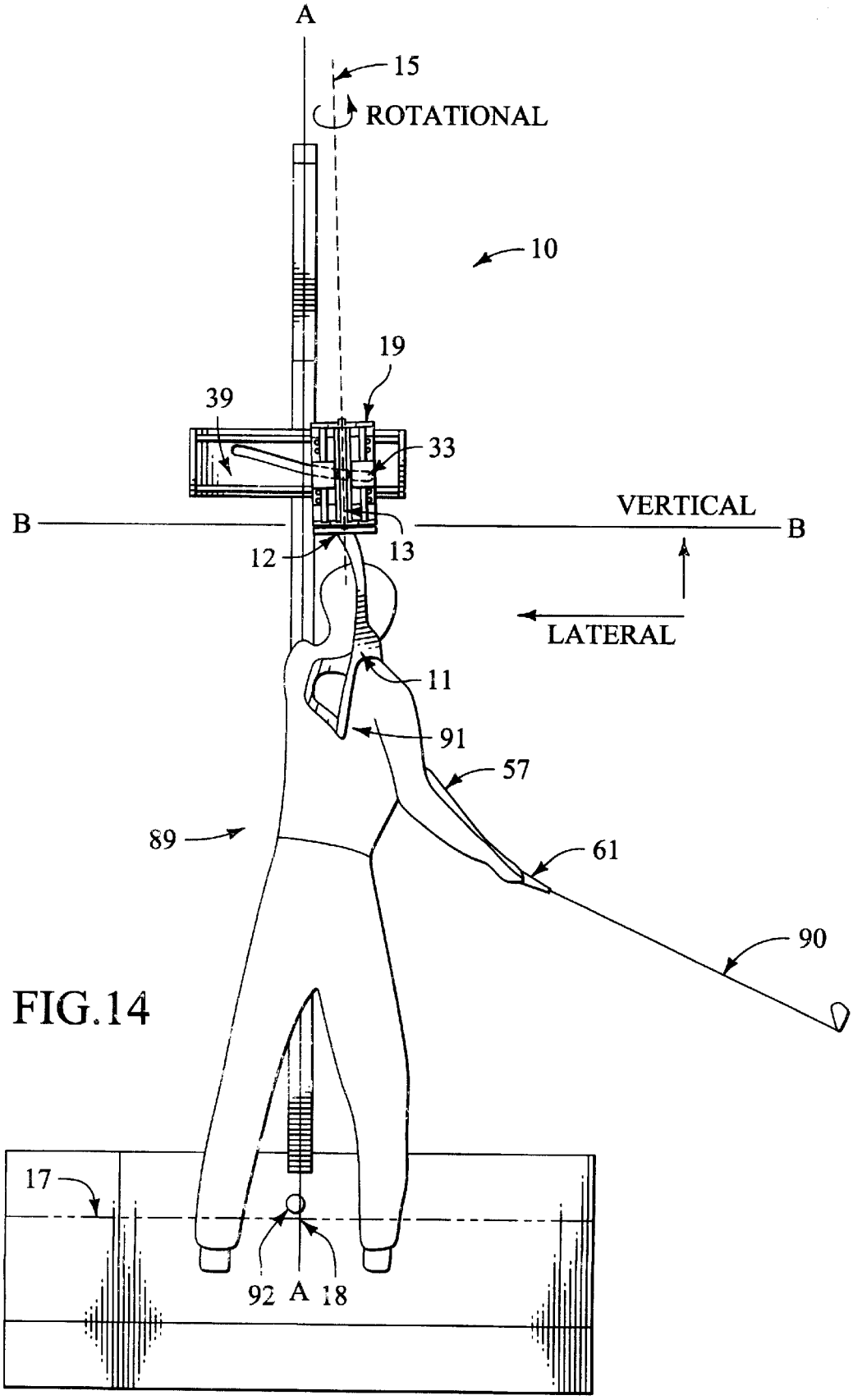
FIG. 14 is a front elevational view similar to FIGS. 11–13 of the golf swing training device of FIG. 1 being used by a user who is in the process of executing the down swing portion of a golf swing.

FIG. 14 shows a right-handed user 89 who is in the process of executing the down swing portion of a golf swing. The golf club 90 is accelerating toward the golf ball 92 as the user 89 rotates back toward the address position. Note that the attachment point 12 between the yoke 11 and the end 14 of the rotatable member 13 is moving laterally in the direction of the target and away from the horizontal plane 21 as the user 89 rotates his or her hips and upper torso 91 back toward the address position in the direction of the target.

The head of the golf club accelerates as the shaft of the golf club head moves from a position at the top of the back swing that generally parallels the target line 17 to a position at the bottom of the down swing where the shaft of the golf club is generally perpendicular to the target line 17. The golf swing training device 10 according to the present invention together with the optional extensible rod 57 and coupler 61 assembly insures that the face of the golf club is maintained in a relatively square position relative to the target line 17. Because the extensible rod 57 and hinge 62 only permit the golf club to be moved on the proper axis, the horizontal grooves in the face of the golf club will be kept generally square or perpendicular to the target line 17 while the face of the golf club head is in contact with the golf ball. Also, the device prevents the user from moving in such a manner as to destroy the centripetal force which is necessary in order to maximize the centrifugal force exerted at the head of the golf club.

Figure 15:
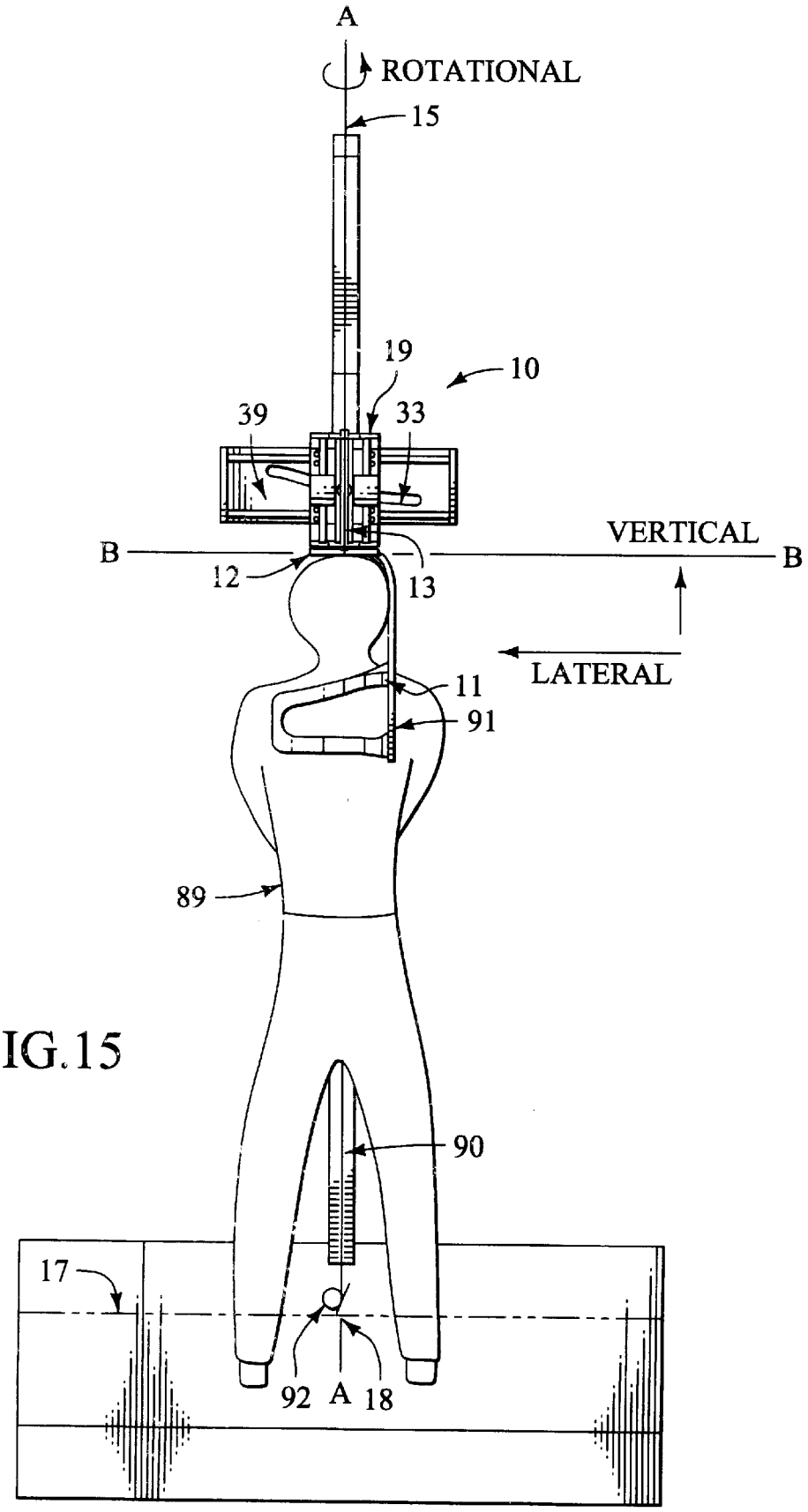
FIG. 15 is a front elevational view similar to FIGS. 11–14 of the golf swing training device of FIG. 1 being used by a user who is in the process of transitioning from the down swing to the follow through portion of a golf swing.

FIG. 15 shows a right-handed user 89 transitioning from the down swing portion of the golf swing to the follow through portion of the golf swing. The attachment point 12 between the yoke 11 and the end 14 of the rotatable member 13 has returned to the point where it is bisected by the fixed vertical and horizonal reference lines A—A and B—B, respectively. At this point in the golf swing, the head of the golf club 90 collides with and begins to transfer energy to the golf ball 92.

As the user continues the swing rotation, the golf ball springs off the face of the club head and flies in the direction of the target. The user will instantaneously see, hear, and feel what a properly struck golf ball looks, sounds, and feels like. The user finishes the golf swing rotation in a rotational move called the follow-through. As with the back swing, the golf swing training device 10 according to the present invention guides the user's arms in the proper position relative to the golf club, which teaches the user to execute a full turn toward the target.

Figure 16:
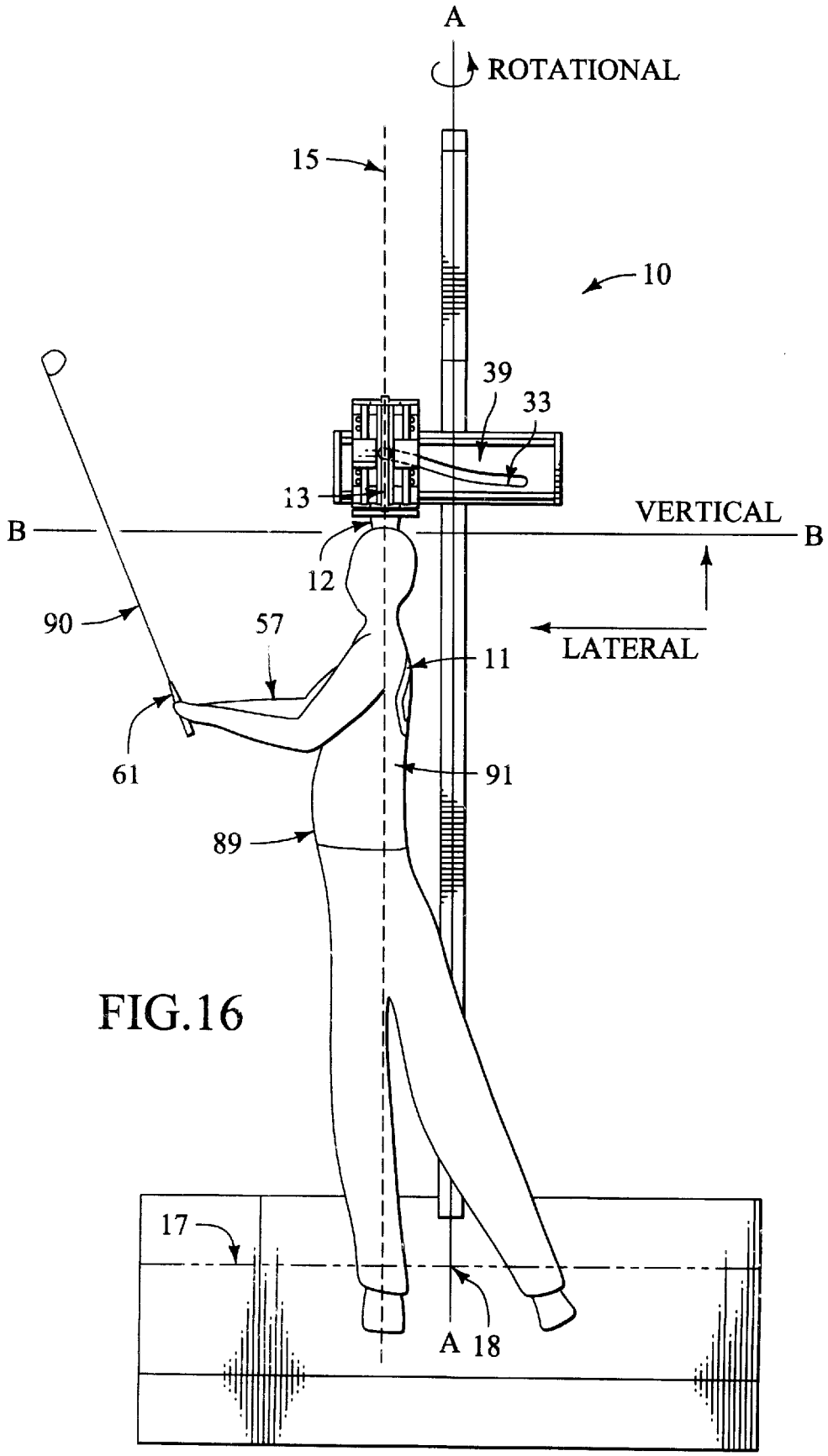
FIG. 16 is a front elevational view similar to FIGS. 11–15 of the golf swing training device of FIG. 1 being used by a user who is in the process of executing the follow through portion of a golf swing.

FIG. 16 shows the position of a right-handed user 89 during the process of executing the follow through portion of a golf swing. Note that the attachment point 12 between the yoke 11 and the end 14 of the rotatable member 13 is now to the left of and above the fixed vertical and horizontal reference lines A—A and B—B, respectively. The golf swing training device 10 according to the present invention has guided and coordinated the rotational, lateral, and vertical movements of the upper torso of the user 89 throughout the golf swing.

In a preferred embodiment, the extensible rod 57 includes an upper portion 64 that is free to rotate on the longitudinal axis 58 relative to the lower portion 65. By permitting this rotation along the longitudinal axis 58, the user can learn to rotate or roll his or her wrists and arms in conjunction with a proper turn as the club face strikes the golf ball during the golf swing. Once learned through kinesthesia (i.e., by feel or muscle memory through sensory perception), this technique allows the user to hit a golf ball farther and with greater force than a swing without a wrist roll. For those users who are just beginning to learn how to execute a golf swing or who are correcting a previously grooved swing flaw, a locking pin 88 can preferably be used to restrict rotation of the upper portion 64 of the extensible rod 57 relative to the lower portion 65 until a swing with proper mechanics is learned and grooved. Thus, the golf swing training device 10 of the present invention allows the user to isolate various aspects of the swing in order to address certain swing flaws during practice.

The golf swing training device 10 is intended to involve as many of the user's senses as possible. The golf swing training device 10 provides a visual reference for the user to see where his or her arms, body, and golf club should be during a properly executed golf swing. Additionally, the golf swing training device 10 involves the user's sense of touch, or kinesthesia, by allowing the user to feel the grips of his or her own actual playing golf clubs as well as the contact between the user's upper torso and the yoke 11. Moreover, the user can feel and hear what a properly struck golf ball is supposed to feel and sound like. In a preferred embodiment, the hinge 62 also includes a spring-loaded detent which provides an audible click when the hinge 62 pivots on its pivot axis 63 during the golf swing. If the golf swing is being executed properly, the click of the detent will be heard when the user is in the same position each time.

It will be appreciated that the golf swing training device 10 according to the present invention can be attached to any of the user's playing actual playing clubs. Thus, a user can practice a golf swing and hit golf balls as noted above with each and every playing club, from a driver to a sand wedge. The device can be used to practice full swings to pitch shots and chip shots. Furthermore, the device can also be used to practice the putting stroke.

To use the optional brace 53, the brace 53 is connected to the base 51 by inserting brace pins 54 in corresponding brace pin receiving holes 55. The brace 53 is then adjusted using the pivoting clamp assembly 56 so that it contacts an appropriate point on either of the user's legs or hips. Depending upon the type of instruction being given to the user at a given time, the brace 53 can contact any point on either of the user's legs from the lower shin up to the user's hips. The brace 53 is used primarily to give the user something to bear against as a reference point during the swing, which helps the user create a stable foundation upon which the dynamics of the full swing are based. The brace 53 can help the user isolate the user's lower body relative to the upper torso during the golf swing.

In some respects, learning to properly execute a golf swing is similar to learning to play a musical instrument such as the piano. In both instances, one must engage in substantial practice in order to properly execute the necessary physical movements to accomplish the intended goal. In the case of learning to play the piano, one must train one's fingers to strike the proper keys in the proper order to make music. In the case of learning to properly execute a golf swing, one must train one's entire body to move in the proper position at all times during the swing in order to properly strike the golf ball. The principle difference between the two acts involves the lack of objective "keys" or positions in a golf swing as compared to most musical instruments. The keys on a piano are visible and in a fixed location and thus can be readily found and used as a reference point by one learning to play the piano. Moreover, when an improper key is struck, one can audibly detect the error and strive to correct it. In contrast, one learning to execute a golf swing has no objective positions, keys, or other reference points to consult. The user must find swing positions (i.e., the "keys") without any fixed visual, audible, or tactile guidance. Furthermore, it is sometimes difficult for a golfer to appreciate the difference between a properly struck golf ball and one which was not hit properly.

The golf swing training device 10 according to the present invention provides the user with an objective set of "keys" that a user can use to locate proper, repeatable, consistent positions in a golf swing. Moreover, after practicing and learning the "key" positions of a properly executed golf swing using the golf swing training device 10 according to the present invention, the user can use the device to practice and implement variations on a properly executed swing that can enhance and improve his or her golf game. Continuing with the piano analogy, the ability of the user to learn variations of the golf swing is similar to the pianist learning to strike the keys of a piano in various interpretive ways (e.g., long notes, crescendos, staccato notes, and other interpretive moves). The interpretive shots in golf, which are essential to achieving low scores, involve varying such things as swing tempo, softness of shots, grip pressure, the angle of the blade of the club relative to the swing path, and other minor adjustments. In all cases, however, it is essential that the user have a constant set of positions or "keys" to serve as a reference point for the swing.

A preferred golf swing training device 10 according to one preferred embodiment of the invention preferably allows the user to adjust the first angle 20 and second angle 22 prior to executing the swing. The adjustment can be made in the upright 52 that supports the guide assembly 19, or it can be made in the guide assembly 19 itself. The adjustment of the first angle 20 and second angle 22 allows the user to adjust the degree to which the golfer bends at the waist forward toward the golf ball at the address position, which is called a spine angle, and also the degree to which the golfer bends at the waist either toward or away from the target, which is called the tilt angle.

Another feature of the invention involves the ability of a user to use the device to quickly recover a proper swing after a lay off from playing golf or other periods of inactivity. Since there are generally no objective keys in a golf swing to serve as a frame of reference, a golfer who does not swing a golf club for a few days will begin to lose the feeling or kinesthesia of correct swing positions. However, through use of the golf swing training device 10 of the present invention, the golfer can return from a lay off to reasonable performance levels after a comparatively short period of practice because the device will help the golfer recall the "keys" or positions and motions of a properly executed golf swing. Rapidly refreshing one's muscle memory and maintaining the muscle tone for a golf swing can heighten a golfer's enjoyment of the game of golf and raise the golfer's confidence on the golf course.

Additional advantages and modifications will readily occur to those skilled in the art. Therefore, the invention in its broader aspects is not limited to the preferred embodiments and illustrative examples shown and described herein. Accordingly, various modifications may be made without departing from the spirit or scope of the general inventive concept as defined by the appended claims and their equivalents.

What is claimed is:

1. A golf swing training device for use in guiding and coordinating a users body position and lateral, vertical, and rotational movement when executing a golf swing, the golf swing including a back swing, a down swing, and a follow through, the golf swing being conducted relative to a target line that extends generally horizontally from a golf ball position to an intended target, the device comprising:

a yoke for engaging the upper torso of the user, the yoke including an attachment point for being positioned above and intermediate the user's shoulders;

a rotatable member having an end connected to the attachment point of the yoke and having an axis of rotation lying within a first plane that is generally parallel to the target line; and a guide assembly for maintaining the orientation of the rotatable member such that a first angle between the first plane and a generally horizontal plane that contains the target line and a second angle between the axis of rotation of the rotatable member and a line of intersection between the first plane and the generally horizontal plane both remain constant while the rotatable member simultaneously rotates and moves laterally away from the target and toward the generally horizontal plane as the user executes the back swing and counter-rotates and moves laterally toward the target and away from the generally horizontal plane as the user executes the down swing and the follow through.

2. The golf swing training device as in claim 1 wherein the rotatable member comprises an upper section and a lower section, the upper section having an axis of rotation that is fixed generally perpendicular to the horizontal plane, the lower section being connected to the upper section and having an axis of rotation lying within a first plane that is generally parallel to the target line and an end connected to the attachment point of the yoke, the orientation of the lower section of the rotatable member being maintained such that a first angle between the first plane and a horizontal plane that contains the target line and a second angle between the axis of rotation of the rotatable member and a line of intersection between the first plane and the horizontal plane both remain constant while the rotatable member simultaneously rotates and moves laterally away from the target and toward the horizontal plane as the user executes a back swing and counter-rotates and moves laterally toward the target and away from the horizontal plane as the user executes a down swing and follow through.

3. The golf swing training device as in claim 1 wherein the yoke comprises:

a front portion for positioning generally adjacent to the user's chest;

a back portion for positioning generally adjacent to the user's back; and a connecting portion connecting the front portion and the back portion and extending to an attachment point for positioning above and intermediate the user's shoulders.

4. The golf swing training device as in claim 3 wherein the connecting portion includes means for adjusting the distance between the front portion and the back portion.

5. The golf swing training device as in claim 1 wherein the guide assembly permits the first angle, the second angle, and the distance between the end of the rotatable member and the horizontal plane to be adjusted before the user executes a golf swing.

6. The golf swing training device as in claim 1 wherein the guide assembly comprises:

a shaft having a first gear fixedly attached at one end and a cam follower attached at the other end, the first gear meshing with a second gear fixedly attached to the rotatable member, the axis of the second gear being concentric to the axis of rotation of the rotatable member, a camming surface; and a housing for journalling the shaft and the rotatable member in a fixed orientation relative to each other, the rotatable member rotating and moving laterally away from and toward the target and toward and away from the horizontal plane as the cam follower passes along in contact with the camming surface.

7. The golf swing training device as in claim 6 wherein the camming surface permits the rotatable member to move laterally about 4 inches and toward the horizontal plane about 0.75 inches while the rotatable member rotates up to about 90° on the axis of rotation as the user executes a back swing, and permits the rotatable member to move laterally about 8 inches and away from the horizontal plane about 2.5 inches while the rotatable member counter-rotates up to about 180° on the axis of rotation as the user executes a down swing and follow through.

8. The golf swing training device as in claim 1 further comprising:

a base; and at least one upright connected to and extending from the base, the upright connected to and supporting the guide assembly.

9. The golf swing training device as in claim 8 wherein the upright permits the first angle, the second angle, and the distance between the end of the rotatable member and the horizontal plane to be adjusted before the user executes a golf swing.

10. The golf swing training device as in claim 8 further comprising a brace connected to and extending from the base, the brace making contact with and limiting the movement of at least one of the user's legs as the user executes a golf swing.

11. The golf swing training device as in claim 3 further comprising:

an extensible rod having a longitudinal axis, a first end, and a second end, the first end of the extensible rod being pivotally connected to the front portion of the yoke proximal to the user's sternum;

a coupler for attachment to the grip end of the golf club; and a hinge connecting the coupler to the second end of the extensible rod, the hinge having a pivot axis being disposed generally perpendicular to the longitudinal axis of the extensible rod.

12. The golf swing training device as in claim 11 wherein the extensible rod comprises an upper portion terminating in the first end and a lower portion terminating in the second end, the upper portion and the lower portion being slidably connected so as to permit movement relative to each other along the longitudinal axis.

13. The golf swing training device as in claim 12 wherein the upper portion and the lower portion are rotatably connected so as to permit rotation relative to each other on the longitudinal axis.

14. The golf swing training device as in claim 11 wherein the coupler comprises an alligator clamp assembly.

15. The golf swing training device as in claim 14 wherein the alligator clamp assembly comprises an upper jaw and a lower jaw each connected to a pair of opposing hinge plates, the upper jaw and the lower jaw having ridges on their facing surfaces for frictionally engaging the grip end of a golf club when the upper jaw and lower jaw are clamped together.

16. The golf swing training device as in claim 11 wherein the coupler comprises a socket formed from a resilient material to frictionally engage the grip end of a golf club.

17. The golf swing training device as in claim 11 wherein the hinge further comprises a spring-loaded detent element which bears against the hinge and emits an audible click as the coupler rotates on the pivot axis relative to the extensible rod.

18. A golf swing training device for use in guiding and coordinating a user's body position and lateral, vertical, and rotational movement when executing a golf swing that includes a back swing, a down swing, and a follow through, the golf swing being conducted relative to a target line extending horizontally in the direction of an intended target from a point at which the user would strike a golf ball with a golf clubs the device comprising:

a yoke for engaging the upper torso of the user, the yoke comprising a front portion disposed generally adjacent to the user's chest, a back portion disposed generally adjacent to the use's back, and a connecting portion connecting the front portion and the back portion and extending to an attachment point located above and intermediate the user's shoulders;

a rotatable member comprising an upper section and a lower section, the upper section having an axis of rotation that is fixed generally perpendicular to the horizontal plane, the lower section being connected to the upper section by a U-joint and having an axis of rotation lying within a first plane that is generally parallel to the target line and having an end fixedly connected to the attachment point of the yoke, the orientation of the lower section of the rotatable member being maintained such that a first angle between the first plane and a horizontal plane that contains the target line and a second angle between the axis of rotation of the rotatable member and a line of intersection between the first plane and the horizontal plane both remain constant while the rotatable member simultaneously rotates and moves laterally away from the target and toward the horizontal plane as the user executes a back saving and counter-rotates and moves laterally toward the target and away from the horizontal plane as the user executes a down swing and follow through;

a shaft having a first gear fixedly attached at one end and a cam follower attached at the other end, the first gear meshing with a second gear fixedly attached to the upper section of the rotatable member, the axis of the second gear being concentric to the axis of rotation of the upper section of the rotatable member;

a housing for journalling the shaft and the upper section of the rotatable member in a fixed orientation relative to each other;

a first rail mounted within the housing, the first rail being disposed parallel to the axis of rotation of the upper section of the rotatable member;

a carriage assembly including a bushing guiding and slidably supporting the first rail, the carriage assembly riding on and being supported by a second rail that is generally perpendicular to the axis of rotation of the upper section of the rotatable member and that extends in a lateral direction generally parallel to the target line;

a plate having a front surface and a rear surface, the front surface of the plate including a camming surface for engagement with the cam follower, the camming surface defining and limiting the movement of the rotatable member laterally away from and toward the target and toward and away from the horizontal plane;

a pair of opposing rail mounts projecting from the front surface of the plate, the second rail being mounted between the opposing rail mounts in a fixed relationship parallel to the front surface of the plate;

a drum mounted concentrically on the shaft;

a cable extending between the opposing rail mounts, the cable being in frictional contact with the drum, the friction between the cable and drum causing the shaft to rotate in relation to the movement of the cam follower along the camming surface;

an upright connected to the rear surface of the plate, the upright extending to and being supported by a base.

19. The golf swing training device as in claim 18 further comprising a brace connected to and extending from the base, the brace making contact with and limiting the movement of at least one of the user's legs as the user executes a golf swing.

20. The golf swing training device as in claim 18 further comprising:

an extensible rod having a longitudinal axis, the extensible rod comprising a tubular upper section, a cylindrical middle section, and a lower section, the tubular upper section having an open end and a closed first end, the closed first end of the extensible rod being pivotally connected to the front portion of the yoke proximal to the user's sternum, the cylindrical middle section having one end disposed within the open end of the tubular upper section and another end rotatably connected to the lower section such that the rotational axis is coincident to the longitudinal axis defined by the extensible rod, the lower section terminating in a tongue portion;

a coupler for attachment to the grip end of the golf club, the coupler comprising an alligator clamp assembly; and a hinge connecting the coupler to the tongue portion of the lower section of the extensible rod, the hinge having a pivot axis being disposed perpendicular to the longitudinal axis of the extensible rod.

21. The golf swing training device as in claim 20 further comprising a stop for limiting the range of rotation of the cylindrical middle section relative to the lower section.

* * * * *

UNITED STATES PATENT AND TRADEMARK OFFICE

CERTIFICATE OF CORRECTION

PATENT NO. : 6,371,863 B1
DATED : April 16, 2002
INVENTOR(S) : Moran, Thomas F.

It is certified that error appears in the above-identified patent and that said Letters Patent is hereby corrected as shown below:

Column 23,
Line 20, delete “clubs” and insert -- club --;
Line 24, delete “use’s” and insert -- user --

Signed and Sealed this

Eighteenth Day of June, 2002

*Attest:*

*Attesting Officer*

JAMES E. ROGAN
*Director of the United States Patent and Trademark Office*